US009551469B2

(12) United States Patent
Grigore

(10) Patent No.: US 9,551,469 B2
(45) **Date of Patent: *Jan. 24, 2017**

(54) LINEAR LIGHTING SYSTEMS, MANUFACTURING AND METHODS TO CONFIGURE THE SAME

(71) Applicant: Valerica Grigore, Longmont, CO (US)

(72) Inventor: Valerica Grigore, Longmont, CO (US)

( * ) Notice: Subject to any disclaimer, the term of this patent is extended or adjusted under 35 U.S.C. 154(b) by 88 days.

This patent is subject to a terminal disclaimer.

(21) Appl. No.: 14/708,134

(22) Filed: May 8, 2015

(65) Prior Publication Data

US 2015/0330595 A1 Nov. 19, 2015

Related U.S. Application Data

(63) Continuation-in-part of application No. 14/672,146, filed on Mar. 28, 2015.

(60) Provisional application No. 61/993,486, filed on May 15, 2014.

(51) Int. Cl.

| | |
|---|---|
| ***F21V 29/00*** | (2015.01) |
| ***F21S 8/02*** | (2006.01) |
| ***F21V 23/00*** | (2015.01) |
| ***F21V 29/74*** | (2015.01) |
| ***F21V 33/00*** | (2006.01) |
| ***F21V 17/00*** | (2006.01) |
| *F21Y 101/00* | (2016.01) |

(52) U.S. Cl.

CPC .. *F21S 4/28* (2016.01); *F21S 8/02* (2013.01); *F21V 17/002* (2013.01); *F21V 23/007* (2013.01); *F21V 23/009* (2013.01); *F21V 29/74* (2015.01); *F21V 33/006* (2013.01); *F21Y 2101/00* (2013.01); *Y10T 29/49002* (2015.01); *Y10T 29/49119* (2015.01)

(58) Field of Classification Search

CPC ..... F21S 4/00; F21S 4/08; F21S 6/004; F21V 23/007; F21V 17/002; F21Y 2101/00

See application file for complete search history.

(56) References Cited

U.S. PATENT DOCUMENTS

| | | | | |
|---|---|---|---|---|
| 6,659,623 | B2 * | 12/2003 | Friend | F21V 21/002 250/504 R |
| 7,178,941 | B2 | 2/2007 | Roberge et al. | |
| 7,296,912 | B2 | 11/2007 | Beauchamp | |
| 7,494,258 | B2 | 2/2009 | McNaught | |
| 7,658,506 | B2 | 2/2010 | Dowling | |
| 7,914,171 | B2 * | 3/2011 | Fabbri | F21V 33/0088 362/148 |
| 8,235,539 | B2 | 8/2012 | Thomas et al. | |
| 8,382,314 | B2 | 2/2013 | Ou et al. | |
| 8,613,525 | B2 * | 12/2013 | Shimizu | F21S 2/00 362/218 |
| 8,746,933 | B2 | 6/2014 | Cho et al. | |
| 8,764,220 | B2 | 7/2014 | Chan et al. | |
| 8,777,448 | B2 * | 7/2014 | Shimizu | F21V 3/0445 362/235 |
| 8,820,964 | B2 | 9/2014 | Gould | |

(Continued)

*Primary Examiner* — Ali Alavi

(57) ABSTRACT

Linear lighting fixtures intended to be incorporated into thin architectural surfaces, interconnected and configurable as a continuous run with potential to follow the direction of adjacent planar surface in three dimensional spaces while maintaining the structural integrity of the supporting framework within the scope of the majority of building code specifications.

20 Claims, 18 Drawing Sheets

(56) References Cited

U.S. PATENT DOCUMENTS

| | | | | |
|---|---|---|---|---|
| 8,864,332 | B2 * | 10/2014 | Ter-Hovhannisyan | F21V 29/2293 362/217.12 |
| 8,888,306 | B2 | 11/2014 | Thomas et al. | |
| 8,888,335 | B2 * | 11/2014 | Wang | F21V 21/025 362/370 |
| 8,926,126 | B2 | 1/2015 | Ronen et al. | |
| 8,955,998 | B2 | 2/2015 | Wong et al. | |
| 8,956,005 | B2 | 2/2015 | Thomas et al. | |
| 9,004,717 | B2 | 4/2015 | Ratkus et al. | |
| 9,004,718 | B2 | 4/2015 | Myers et al. | |
| 2011/0255276 | A1 | 10/2011 | Coward | |
| 2011/0273877 | A1 | 11/2011 | Reed et al. | |
| 2012/0268927 | A1 | 10/2012 | Saito et al. | |
| 2013/0272000 | A1 | 10/2013 | Pearson et al. | |
| 2014/0070724 | A1 | 3/2014 | Gould et al. | |
| 2014/0092596 | A1 | 4/2014 | Deutsch et al. | |
| 2014/0126196 | A1 | 5/2014 | Dixon et al. | |
| 2014/0177209 | A1 | 6/2014 | Carney et al. | |

* cited by examiner

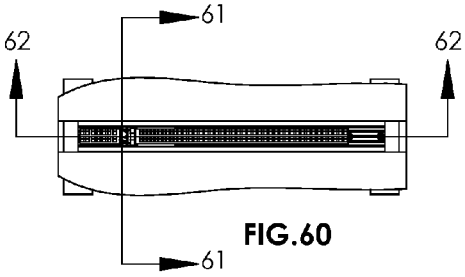
FIG.60
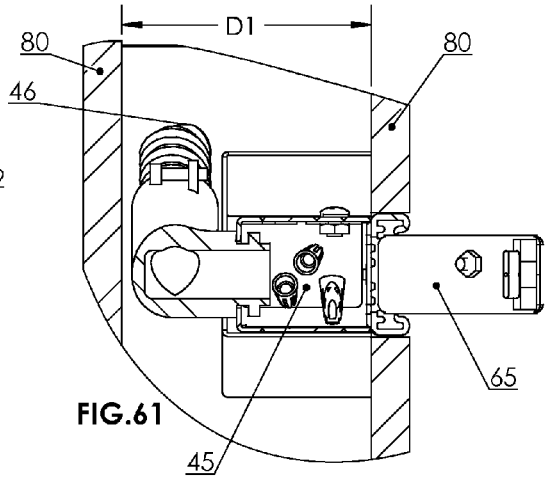
FIG.61
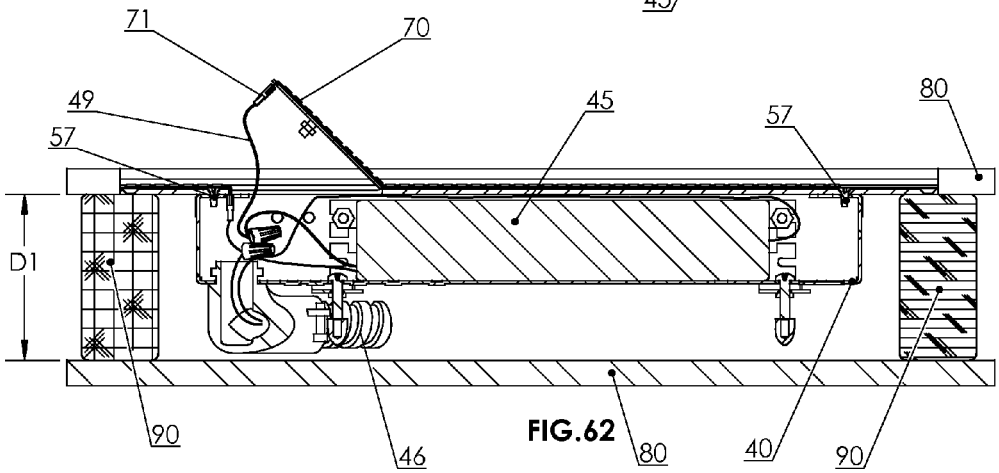
FIG.62
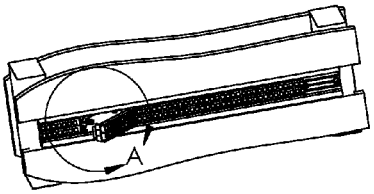
FIG.63
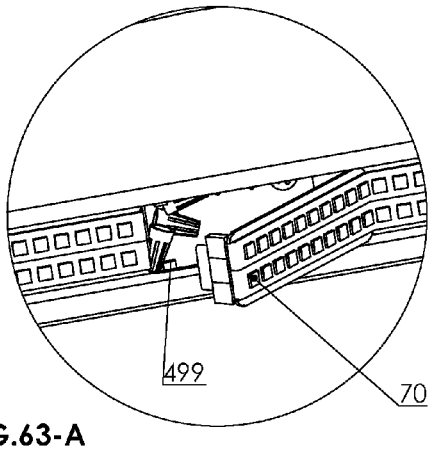
FIG.63-A

LINEAR LIGHTING SYSTEMS, MANUFACTURING AND METHODS TO CONFIGURE THE SAME

CROSS REFERENCE TO RELATED APPLICATIONS

This application claims priority under 35 U.S.C. §119 to U.S. Provisional Patent Application No. 61/993,486, titled "LINEAR LIGHTING SYSTEMS, MANUFACTURING AND METHODS TO CONFIGURE THE SAME", filed on May 15, 2014. This application is a continuation-in-part of Utility application Ser. No. 14/672,146, titled "LINEAR LIGHTING SYSTEM, MANUFACTURING AND METHODS TO CONFIGURE THE SAME", and filed on Mar. 28, 2015.

BACKGROUND OF INVENTION

The majority of small form factor of linear lighting fixtures have their power supply driver in a remote location due to the fact that there is no room for integral drivers in those types of fixtures. These systems have performance losses caused by their long wires and are more difficult to install than integral driver fixtures.

The remote driver box fixtures are not U.L. approved for battery packs because most of the battery packs should be factory installed not field installed.

The installer have to drill thru every joist up to the last one near the fixture and route the electrical conduit from the remote driver compartment. This is additional labor and it would considerably increase the overall cost related to this job.

International residential building code prescribes limitations for notching and bored holes in both interior and exterior walls.

The decision about the location of the remote driver compartment is left to the installer and he can run into issues when he is limited by the length of the wire due to limitations imposed by manufacturer for power loss in the wire. He has to take extra steps to add up the segments of the wire way path and figure out the total length. In some situations he has to consult other people like the architect, designer, electrical engineer, building owner, contractors, etc. and incur delays due to these complexities.

For existent construction or remodeling there is a risk to interfere with electrical conduit runs, HVAC ducts or plumbing pipes as these are hidden inside the wall and most initial plans are not available or consulted before the work is started.

Those fixtures with integral driver compartment are designed as to allow driver access and maintenance, from the room side, but they require cutting and reframing structural members that are intended to support the walls and/or ceiling. This could extend or invalidate the building approvals required by the code or other authority therefore extending the overall lead time unnecessary.

Traditional shallow linear recessed fixtures are not usually designed to allow access to replace the light engine while the maintenance of their remote drivers is more difficult than of those fixtures with integral driver.

The warranty for the L.E.D. driver is usually under 5 years while L.E.D.s could have double that lifetime.

The power input of these runs is usually at the end of the fixture. Most of the walls and ceilings would have structural joist members at corner or at the end edges therefore these fixtures are not versatile and are not designed for what is mostly needed: end to end, transition corners, etc.

Most of the other fixtures could not be installed after the planar surface is up, on existent construction. Most of them are for new construction and to be installed before the planar surface is installed.

Various fixtures have been proposed to secure the light sources to the architectural surfaces. Typically, these fixtures have a relatively large depth profile that necessitates excessive clearance space behind the ceiling, wall, or floor surface. In most cases, it may be necessary to reframe a wall to add sufficient depth for the lighting fixture, which may also require cutting and reframing window sills, headers, and other architectural features for structural continuity.

Due to its housing depth and because it's installed to the building structure with screws, the integral fixture opening is distorted making the opening variable along the length of the fixture which in turn is not accurate enough to install the light diffusing/converting optical elements like: extruded lens, covers, etc. Additional temporary brackets are used to brace and bridge this opening but they don't eliminate completely the effect and/or they don't control the cause of the distortion (deep housing profile, unknown screw torque force applied by the installed in the field).

SUMMARY OF THE INVENTION

The use of light as an element of design of architectural surfaces is a distinctive trend in modern times. In the near future more and more drivers will be integrated into the L.E.D. board. These are so called IC drivers. We can see that trend in direct line AC L.E.D. boards. These boards are connected directly to main power line without the need of a bulky driver to regulate them. Many consumers will want to convert their fixtures by upgrading their L.E.D. boards and this could eliminate one function of the driver compartment as being the enclosure for an L.E.D. driver but the enclosure will still be needed as storage compartment for the additional L.E.D. tape that is a result of using a tape that is not exactly the length of the concatenated run of fixtures. Also, the enclosure will be needed to contain the wire splices, wire nuts or the electrical connectors used to power the L.E.D. tape. This concept is designed to accommodate both, the current need for a driver compartment and the future upgrade. The future L.E.D. light engines could be housed and be powered directly from the power line integral to the small factor channel housing subject to this design.

In an exemplary embodiment of this invention, a linear fixture system is designed to be installed by cutting the joist, or a structural member, within the allowance of building code combined with the advantage that there is no need to redo the planar surface texture around the opening and could have any direction along the thin surfaces as well as it can be laid out to create formations of various shapes within these surfaces (for example resembling many if not all the capital letters in the alphabet), geometric figures, etc.

The applications of these fixtures are expanded to architectural accent lighting, general/ambient lighting for both, commercial and residential buildings.

The attached driver compartment option is designed to inherit the advantages of the integral fixtures and remove many of their disadvantages. For example a nearby driver would allow short wires between the L.E.D. board and driver therefore reducing considerably the power efficacy loss. The capability to access and replace a faulty driver is another advantage.

Another reason the traditional fixtures are 3" to 5" deep is due to the methods of mixing and diffusing L.E.D. light. The L.E.D.s are oriented directly to the target therefore the point source is visible if it's too close to the lens. Advancements have been done relative to the optics, the diffuser lens are capable to blend the point source into a uniform, glare free, linear source while allowing smaller distances between the diffuser surface and L.E.D. chips.

The light source could be remote phosphor style, traditional white L.E.D. or any other electroluminescent diode that is capable of generating radiation in response to an electrical signal. For example, the light source of a remote phosphor style would comprise of L.E.D.s installed on a printed circuit board (P.C.B.), that would emit blue light, namely a "blue pump" L.E.D, with the dominant wavelength ranging from 450 nm to 460 nm. Above the P.C.B., at a certain distance around the LED, there would be a material that contains phosphor that is intended to convert the wavelength of the photons emitted by the blue pump LEDs to white light spectrum. This phosphor material is separate and not packaged into the L.E.D. therefore it's known as "remote phosphor".

BRIEF DESCRIPTION OF THE DRAWINGS

The foregoing and other features and aspects of the invention are best understood with reference to the following description of certain exemplary embodiments, when read in conjunction with the accompanying drawings, wherein:

FIG. 10-A illustrates an isometric view of a gap created in a planar surface;

FIG. 12-A illustrates another isometric view of a gap created in a planar surface;

FIG. 60 illustrates a front view of a section of line segment row of fixtures installed on a planar surface, in accordance with an exemplary embodiment of the present invention;

FIG. 61 illustrates a section view taken along line segment 61-61, as labeled in FIG. 60, in accordance with an exemplary embodiment of the present invention;

FIG. 62 illustrates a section view taken along line segment 62-62, as labeled in FIG. 60, in accordance with an exemplary embodiment of the present invention;

FIG. 63 illustrates a perspective view of components of a line segment of a run of light fixtures installed in a planar surface, in accordance with an exemplary embodiment of the present invention;

FIG. 63-A illustrates a detail/partial view taken within the circle 'A', as labeled in FIG. 63, in accordance with an exemplary embodiment of the present invention;

Figure 1:
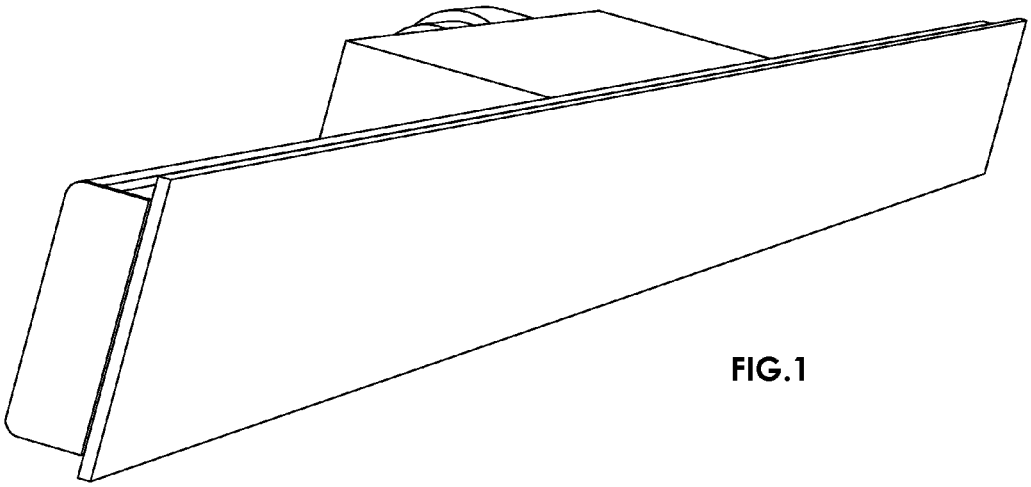
FIG. 1 illustrates an isometric view, frontal perspective, of a line segment of the embodied lighting system, in accordance with an exemplary embodiment of the present invention.
Figure 2:
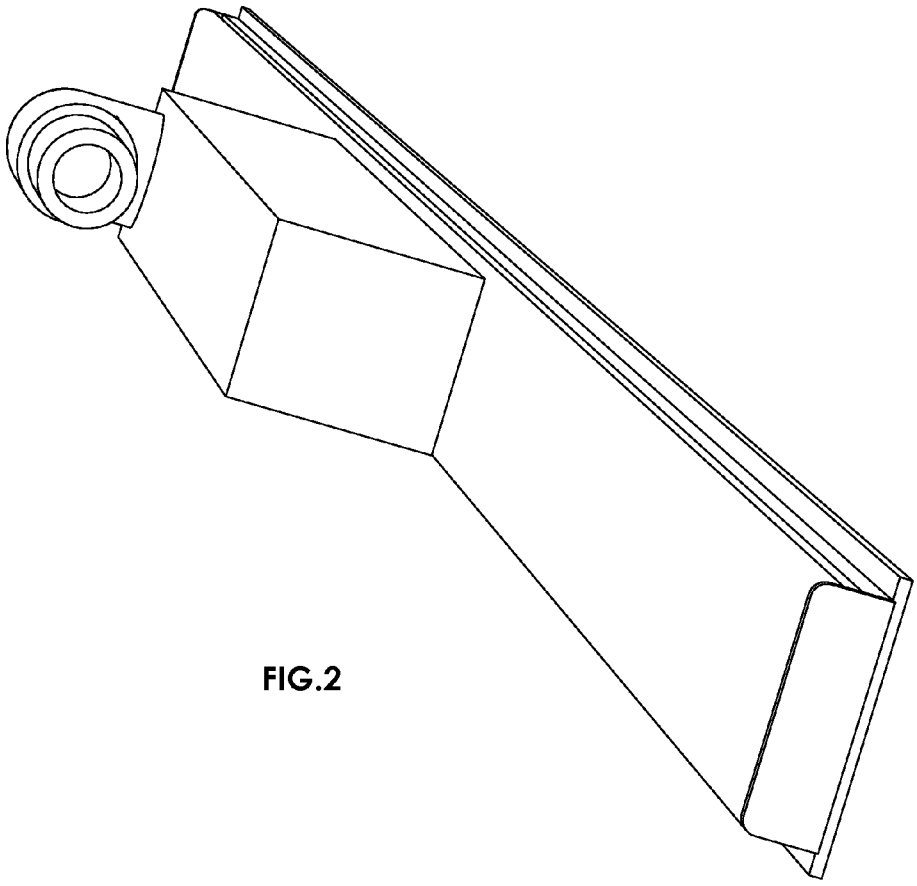
FIG. 2 illustrates an isometric view, rear perspective, of a line segment of the embodied lighting system, in accordance with an exemplary embodiment of the present invention.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF INVENTION

The present invention is focused on methods to configure linear lighting in different interior building spaces. Although the description of exemplary embodiments is provided below in conjunction with interior building structures, alternate embodiments of the invention are applicable to other illuminated open spaces including, but no limited to, transit, tunnels, staircase, sidewalk, landscape, bollards, parking and other outdoor areas. Furthermore, although the invention has been described with reference to specific methods to configure linear lighting fixtures embedded into interior and exterior architectural surfaces, these descriptions are not meant to be construed in a limiting sense to these applications but a disclosure to apply these concepts to other related applications as recessed lighting applications, cove, surface mount, suspended or track lighting.

Furthermore, although some embodiments of the invention have been described with reference to specific methods to configure elongated lighting fixtures, it is within the scope of the invention to apply the same concept to any elongated fixture or to a fixture substantially longer than its width. In one embodiment, the invention is a linear lighting fixture, comprising: a channel segment, mounted on at least two structural members that are supporting a planar surface; an enclosure, disposed between said structural members, adjoined to said channel segment wherein said enclosure is sufficiently recessed behind its mounting surface and containing an electrical device used as a power source and control; a channel housing, abutted to and aligned with said channel segment and mounted on at least one structural member; a wire way chase, mounted recessed in a cut-out performed in said structural member, disposed between said channel and said structural member; a light source, containing electroluminescent diodes, mounted in said channel, and connected to said electrical device; and, a removable cover, mounted on said channel; wherein said channel segment, bearing an opening to access said adjoining enclosure, would allow access, for maintenance, to said power source, after said fixture installation;

In a variation of the embodiment above, the enclosure is placed anywhere along the gap, between the structural members.

In another embodiment, the invention is a linear lighting fixture, comprising: a channel segment, mounted on at least two structural members that are supporting a planar surface; an enclosure, disposed between said structural members, adjoined to said channel segment wherein said enclosure is sufficiently recessed behind its mounting surface and containing an electrical device used as a power source and control; a channel housing, abutted to and aligned with said channel segment and mounted on at least one structural member; a light source, containing electroluminescent diodes, mounted in said channel, and connected to said electrical device; and, a removable cover, mounted on said channel; wherein said channel segment, bearing an opening to access said adjoining enclosure, would allow access, for maintenance, to said power source, after said fixture installation;

In another exemplary embodiment, the invention is an elongated light fixture housing comprising: a channel housing, having one or more complementary located flexible locking features; a removable cover, having one or more complementary located flexible locking features; wherein said complementary located flexible locking features engage functioning as a snap-fit cover attachment system for the elongated light fixture.

In another exemplary embodiment, the invention is an elongated light fixture housing comprising: a channel housing, comprising an outer surface and an inner surface, having at least one indentation integrally formed on its inner surface, in at least one of its side walls; and a removable cover, comprising an outer surface and an inner surface, having at least one complementary indentation integrally formed on its outer surface; wherein said indentation of said channel is for receiving and retaining said complementary indentation of said removable cover and functioning as a snap-fit attachment system of said cover to said channel.

The term "L.E.D." is known in the art and relates to Light-Emitting Diode: a semiconductor diode that emits light when an electric current passes thru it as a result of a specific voltage applied to its terminals.

The term "L.E.D. driver" is known in the art and relates to an electrical device that manages power and controls the current flow to an L.E.D. lighting source. The electrical device is connected to a power source.

The term "driver enclosure" (abbreviated as D.E.2) is related to the L.E.D. driver enclosure, component 40 in our description, and is known in the art as the electrical enclosure housing the L.E.D. driver and constituting a part of the luminaire intended to:

(a) reduce the risk of contact with live parts;

(b) enclose electrical parts and components that can involve a risk of fire;

(c) protect internal parts from mechanical damage; and (d) protect internal parts from the environment.

The term "opening" should be construed per Underwriters Laboratories (U.L.) definition as 'an aperture in an enclosure that is covered or filled by a plug or knockout and that has the potential of becoming an open hole'.

The term "knockout" (abbreviated as K.O.) relates to a partially cut-out opening that is closed until the precut material is removed. A similar explanation should be related to the term "half-shear" that will be used in our detailed description of the invention embodiment.

The term "heat sink" should be construed as a material of a particular shape intended to absorb excessive heat from a surface and dissipate that heat thru other surfaces.

The term "countersink" should be construed as a conical hole cut into a manufactured object.

The term "plaster" should be construed as 'a mixture of lime or gypsum, sand, and water, sometimes with fiber added, that hardens to a smooth solid and is used for coating walls and ceilings'.

The term "spackle" is a trademark referencing a compound used to fill cracks in plaster and produce a smooth surface.

The term "elbow fitting" is used in piping and electrical fittings to define a change of direction of an electrical conduit at a specific angle (usually 90 degrees).

The term "hinge joint" is used in some embodiments of this invention to define an articulation that would allow motion only in one plane.

For the purpose of this invention, the term "structure" is used in reference to the framework of a building such as an edifice for commercial, residential and industrial space or any other construction establishment.

The term "stud" is known as a building material that is used to construct the frame of that building structure.

The term "recessed" is used, in this invention, to define a setback position, of a lighting fixture component, relative to a planar surface or a mounting surface.

The term "channel" is used to reference a lighting fixture element having an elongated base, a first and a second wall, first wall disposed at a certain distance from the second wall, and extending from the base in a common direction therefore forming a cavity with two open ends.

The abbreviation "H.V.W.C.2" meaning 'High Voltage Wire Channel' is in reference to component 20 of the lighting fixture segment and is also labeled as "wire way chase";

The abbreviation "R.PH." meaning 'Remote Phosphor' is in reference to the manufacturing of lens labeled 30, 31, and 32 and is known in the lighting industry as being used in correlation with 'blue' L.E.D. emitters. Alternatively, in another embodiment, the term "removable cover" is used in reference to component 30, 31, 32, 33, or 34, within the scope of the invention, but not limited to that particular embodiment. The removable cover base material could be polycarbonate, acrylic or other light transmissive material.

The abbreviation "L.W.F." meaning 'Lens with Wings as Flanges' is in reference to components 30, 33 and 34.

The abbreviation 'T-slot' represents a groove cut into a material, like aluminum, with a tool having the shape of letter 'T', like an extrusion tool.

In an exemplary embodiment, a fastening method is employed to secure at least two components by interlocking their own features (fastening by shape) or by using intermediate fasteners like screws, clips, clasps, glue, etc.

A "snap-fit" is a mechanical joint system where part-to-part attachment is accomplished with locating and locking features (constraint features) that are homogenous with one or the other of the components being joined. Joining requires the (flexible) locking features to move aside for engagement with the mating part, followed by return of the locking feature toward its original position to accomplish the interference required to latch the components together. "—*The First Snap-Fit Handbook*", Bonenberger, 2000 is incorporated herein by reference. Some examples of locking features are: hooks, ridges, grooves, buttons, holes, depressions, indentations, etc.

Descriptions of snap-fit joints can be found in US patent application no. US20070000922 A1 and U.S. Pat. No. 5,102,253 A incorporated herein by reference. Snap-fits joints advantageously eliminate other joining methods, e.g. screws, clips, and adhesives.

For the purpose of this invention, the term "groove" is a long, narrow cut or depression, especially one made to guide motion or receive a corresponding ridge.

For the purpose of this invention, the term "rib" is a long raised piece of stronger or thicker material across a surface or through a structure.

The term "co-extruded" is used when more than one plastic material is pressed, in the same time, thru the same die, to produce a single piece part;

For the purpose of defining directionality, a coordinate system needs to be related to a linear segment of the lighting system having a light emitting surface normal to Z axis of a cartezian coordinate system while its length is defined in the X direction and its width in Y direction.

Figure 10:
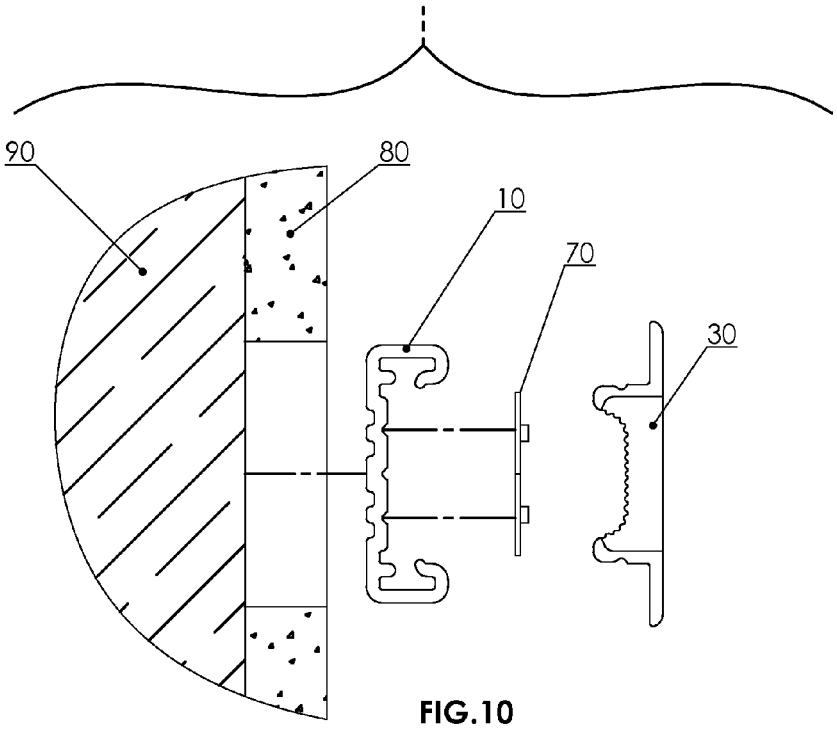
FIG. 10 illustrates an exploded view of a line segment of the concatenated run of linear fixtures to be installed in a planar surface, in accordance with an exemplary embodiment of the present invention.

In an exemplary embodiment, depicted in FIG. 10-A, a planar surface could be a wall 80 that is constructed from one or more drywall sheets arranged on a conventional stud frame. A gap of predefined shape could be created by removing a portion or portions from the one or more drywall sheets. Alternatively, the lighting fixture may first be installed on the studs 90 and the wall may be added later. In other embodiments, the wall may be constructed of wallboard, lathing for plaster, wood, or any other material used to construct an architectural surface.

Figure 11:
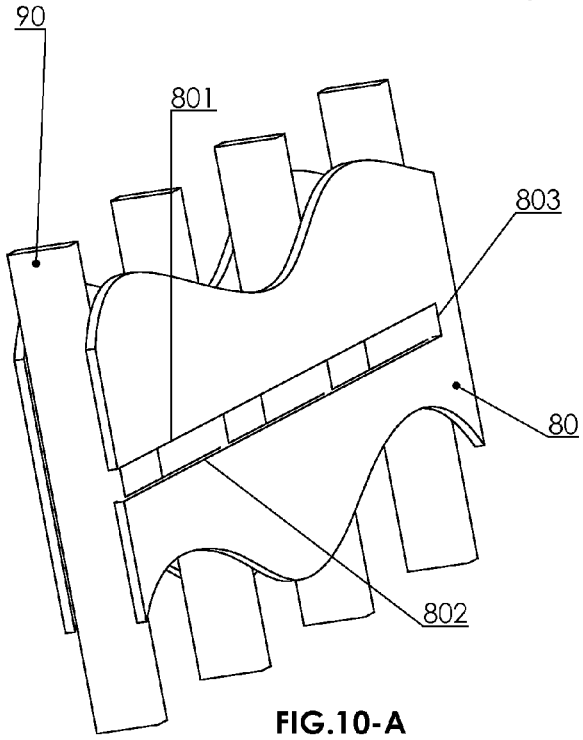
FIG. 11 illustrates a side view of a line segment of the concatenated run of linear fixtures installed in a planar surface, in accordance with an exemplary embodiment of the present invention.
Figure 11:
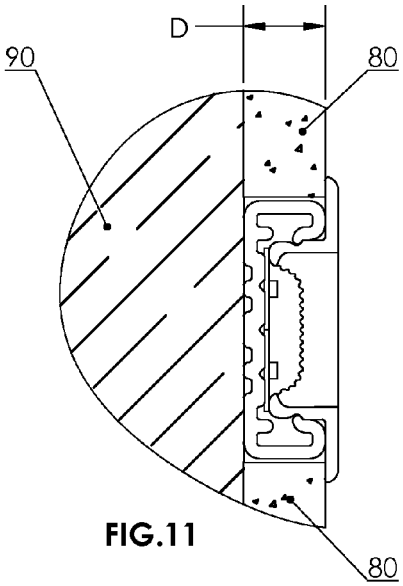

As illustrated by FIG. 10-A, the basic shape of the gap for a linear segment fixture could have two parallel edges 801 and 802 and it might have an end similar to edge 803. The main components of the slim form factor fixture segment is comprised of: aluminum extruded light engine channel housing 10, removable cover or lens 30, and L.E.D. light engine 70. A side view of the main components is illustrated by FIG. 11 while FIG. 10 is intended to clarify the profile of these components in an exploded view.

Figure 12:
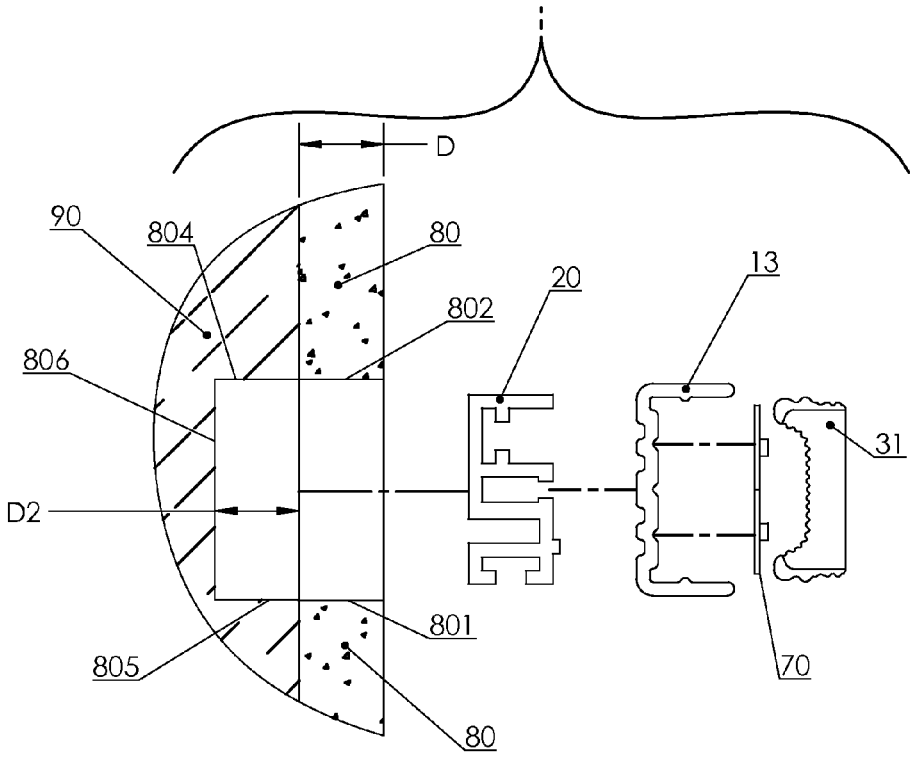
FIG. 12 illustrates an exploded isometric view of another line segment of the concatenated run of linear fixtures to be installed in a planar surface, in accordance with an exemplary embodiment of the present invention.
Figure 13:
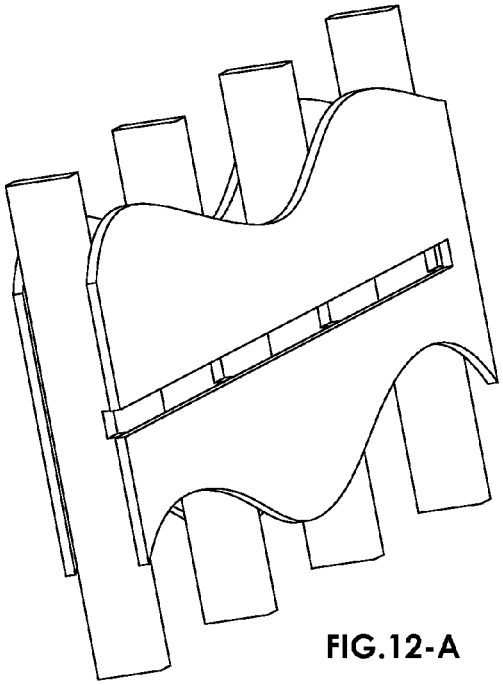
FIG. 13 illustrates a side view of another line segment of the concatenated run of linear fixtures installed in a planar surface, in accordance with an exemplary embodiment of the present invention.
Figure 13:
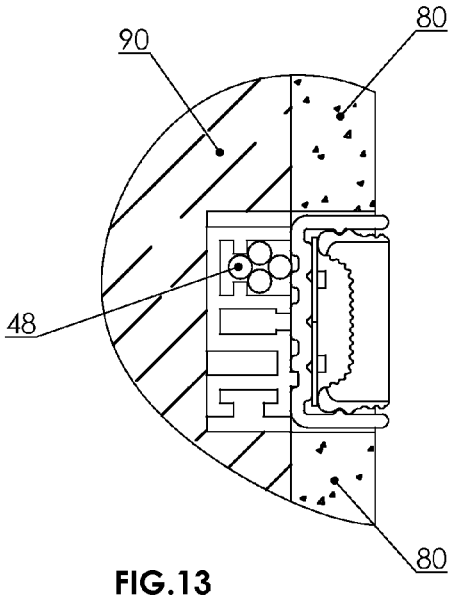
Figure 14:
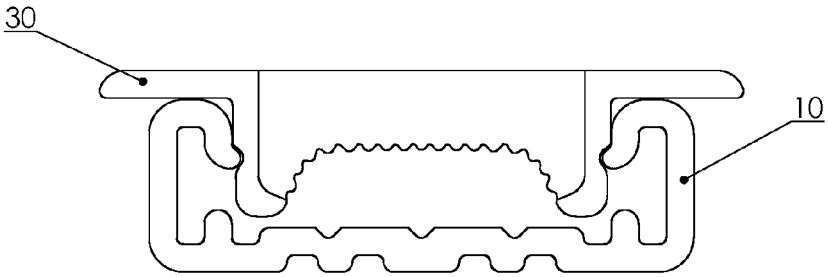
FIG. 14 illustrates a side view of light engine housing, component 10, assembled with the co-extruded lens, component 30, in accordance with an exemplary embodiment of the present invention.

When a flange is not desired, a 'trim less' version could be installed by cutting the drywall and the studs either in the same time with a special tool at the ("D"+"D2") depth, as illustrated by FIG. 12, or sequential, first the drywall up to the studs then the studs within acceptable building code specification at depth D2. The basic shape of the gap for a 'trim less' linear segment fixture, as depicted by FIG. 12, could have two parallel edges 801 and 802 in the drywall, two parallel edges 804 and 805 in the structural member, 806 bottom mounting surface, and it might have an end similar to edge 803. The combined features 804, 805, 806 are labeled as being a "cut-out" formed in the structural element. The main components of the 'trim less' fixture segment is comprised of: separate extruded high voltage wireway chase mounted under the L.E.D. strips housing, component 20, aluminum extruded light engine housing 13, lens 31, and L.E.D. light engine 70. A side view of the main components is illustrated by FIG.13 while FIG.12 is intended to clarify the profile of these components in an exploded view.

Figure 64:
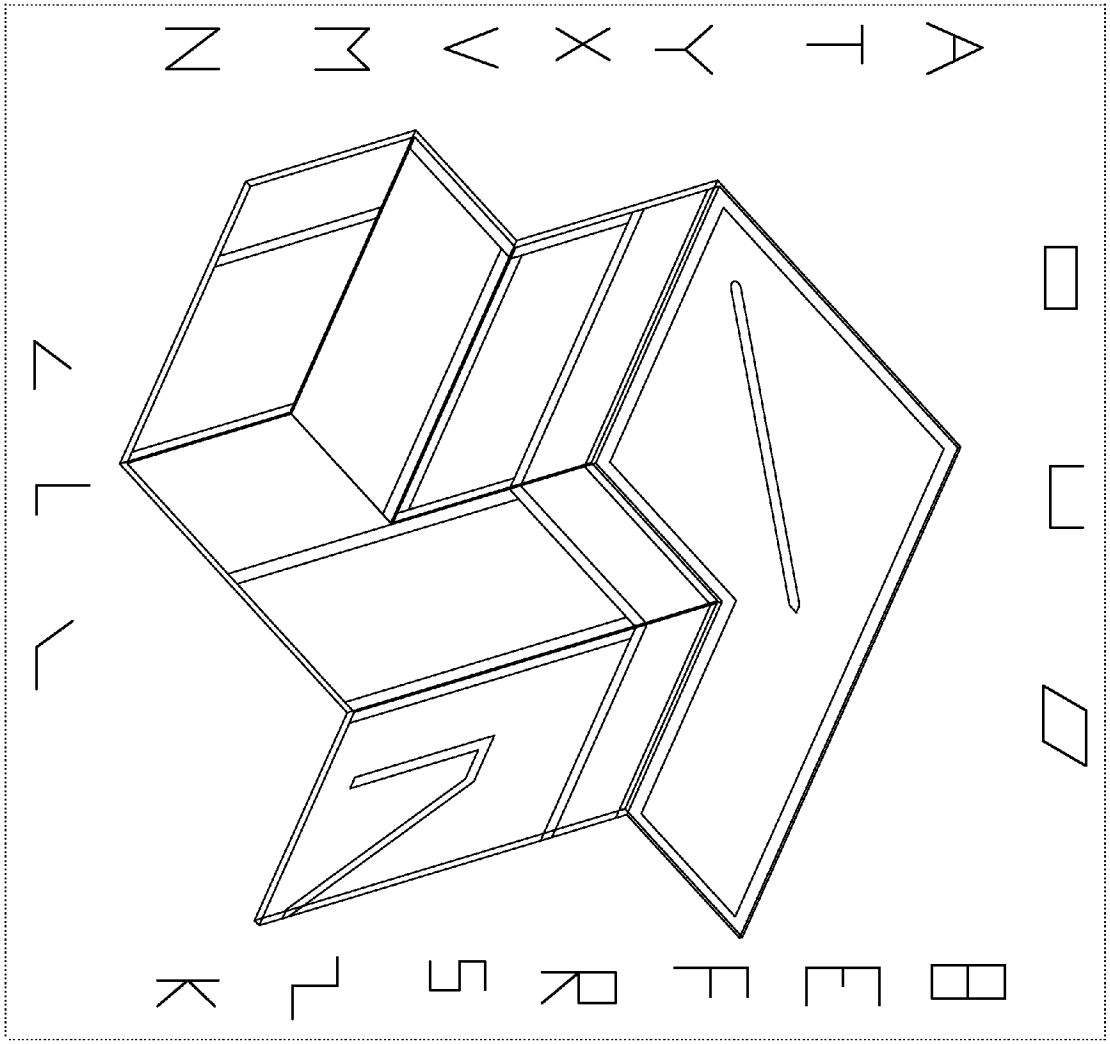
FIG. 64 illustrates a perspective view of some geometrical figures that could be created on three dimensional planar surfaces utilizing the lighting system in accordance with an exemplary embodiment of the present invention.

In an exemplary embodiment, a gap of predefined shape might be formed in the planar surface similar to a concatenated sequence of 'open' line segments with different angles between them. As seen in FIG.64, shapes resembling alphabet letters (A, U, C, H, K, L, M, N, T, V, X, Y, Z) could be created on existent architectural surfaces as well as many other geometric figures.

Figure 27:
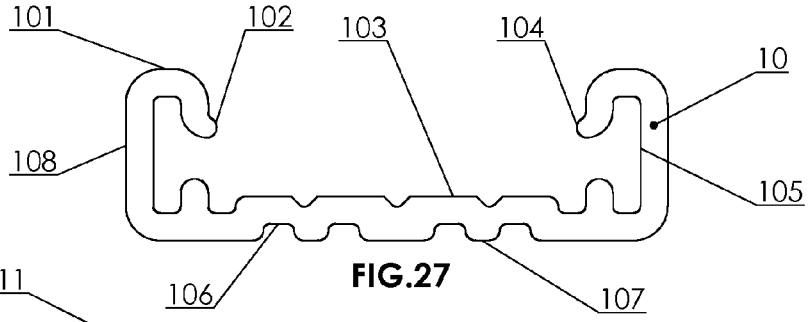
FIG. 27 illustrates a side view of a light engine housing, component 10, in accordance with an exemplary embodiment of the present invention.
Figure 28:
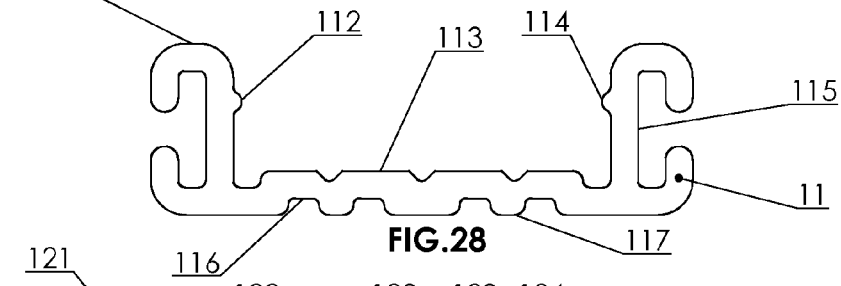
FIG. 28 illustrates a side view of a light engine housing, component 11, in accordance with an exemplary embodiment of the present invention.
Figure 29:
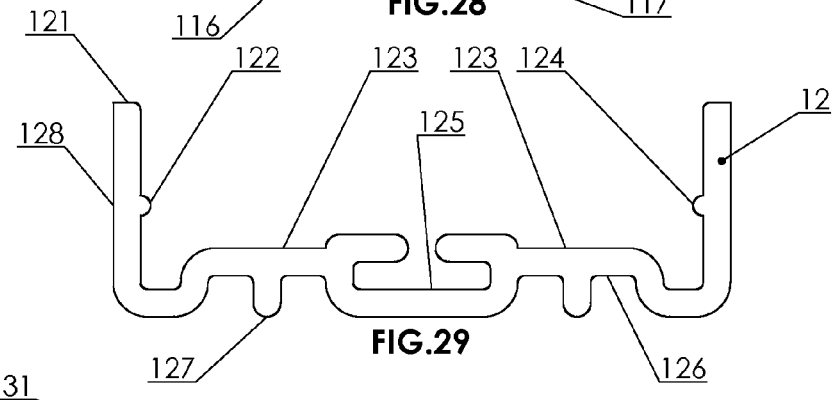
FIG. 29 illustrates a side view of a light engine housing, component 12, in accordance with an exemplary embodiment of the present invention.
Figure 30:
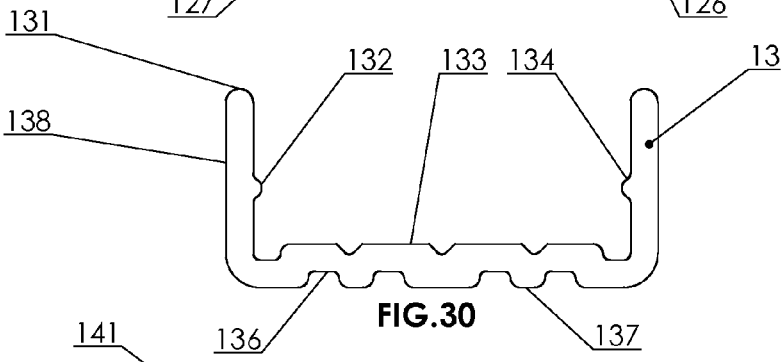
FIG. 30 illustrates a side view of a light engine housing, component 13, in accordance with an exemplary embodiment of the present invention.
Figure 31:
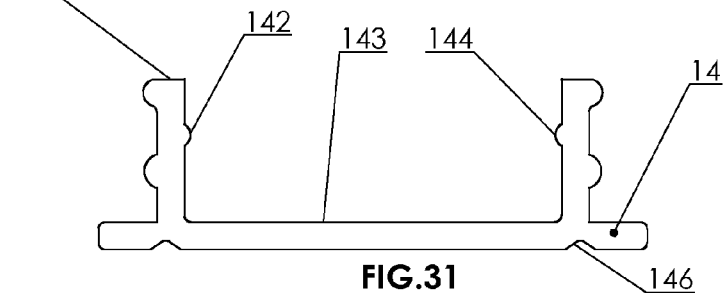
FIG. 31 illustrates a side view of a light engine housing, component 14, in accordance with an exemplary embodiment of the present invention.

In an exemplary embodiment, as depicted in FIG. 27, an important component of the fixture is the aluminum extruded light engine housing 10. This component and its variations, as depicted by components 11, 12, 13 or 14 could be an aluminum extrusion that may or may not be painted depending on certain circumstances. Some of their features, as referenced in FIG. 27 thru FIG. 31: 121 (and its variations 131 or 141) are 'walls' intended to be a protective barrier to block particles, like those of the spackle compound or those of the planar surface 80 illustrated in FIG. 12, from reaching the lens 31 or the light source 70.

Figure 7:
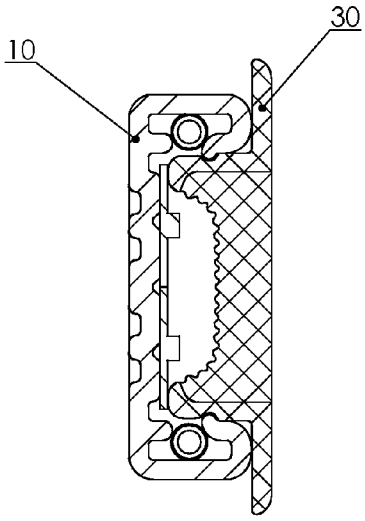
FIG. 7 illustrates section view of a line segment of the concatenated run of linear fixtures taken along section line 7-7 as labeled in FIG. 4, in accordance with an exemplary embodiment of the present invention.
Figure 8:
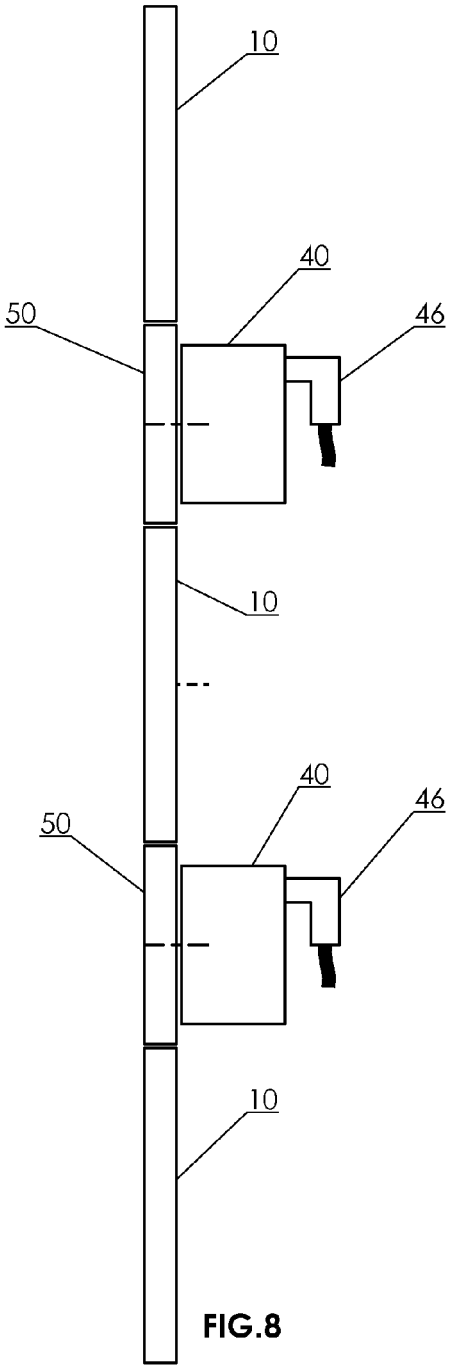
FIG. 8 illustrates a top view of a row of the concatenated run of linear fixtures having flexible conduit feeding each driver enclosure in that row, in accordance with an exemplary embodiment of the present invention.
Figure 9:
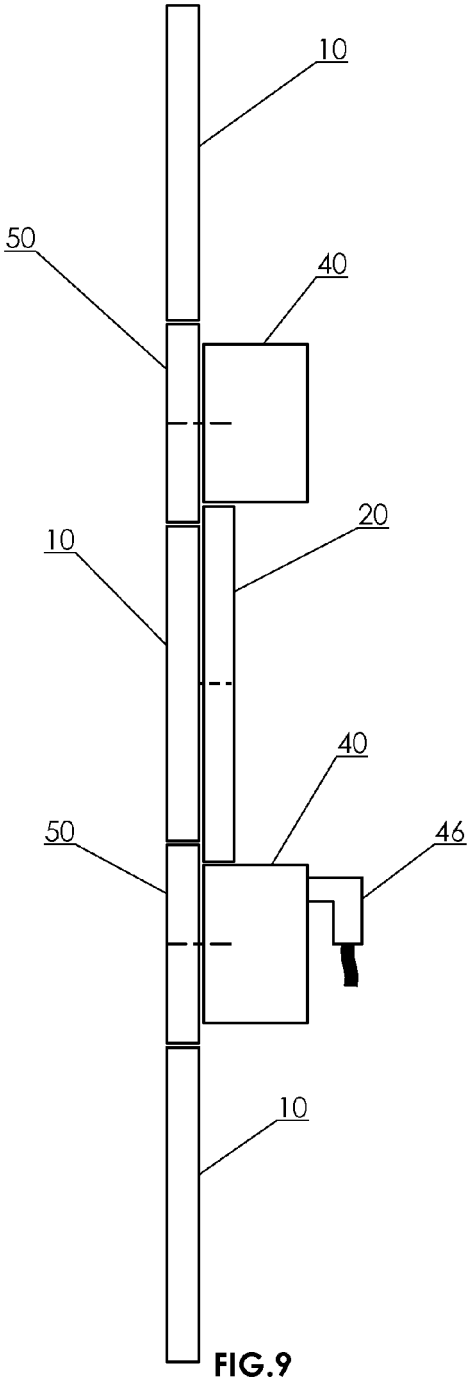
FIG. 9 illustrates a top view of a row of the concatenated run of linear fixtures having power supply fed to one selected driver enclosure in that row and attached wire chase extrusions 20 to deliver the power from the selected driver enclosure to the remaining driver enclosures, in accordance with an exemplary embodiment of the present invention.

The surfaces 108, 128 or 138 might be an exposed or visible surface, in some configurations, therefore serving as a decorative surface with a required finish. The protrusions 102 and 104 (respectively 112 and 114, or 122 and 124 or 132 and 134 or 142 and 144) could be one or multiple pairs intended to retain the lens 30 or its variations 31, 32, 33 and 34, while they are inserted into the housing. They are also designed to allow the removal of the lens while a thin object is inserted, between the lens and the housing, and acceptable force is applied on that object. The surface 103 (or 113, 123, 133, 143) is a mounting surface for the L.E.D. light source 70. The top surfaces 101, 111, 121, 131 or 141 are visible from the room side therefore their alignment is important as they have to be perceived as continuous line independent of the number of fixtures that are in the row. The features 105, 115 or 125 could be described as a 'T' slot. This is intended as a receiver slot for corner cleats or alignment plates as those depicted in FIG. 32 thru FIG. 37. The same slots could be used as screw chase feature designed to receive self tapping screws installed from the end as depicted in FIG. 7. Those screws are used to secure the end caps of the continuous run. The surface 103, 113, 125, 133 or 143 is also the surface where the installer would drill holes to secure the fixtures to the structure with wood screws or could have pre-drilled holes to align and pull the extrusions 10 together with the help of self tapping flat head screws and by using aligner plates 24 thru 25 or corner cleats 26 thru 29. The aligners 24 thru 29, being made of thick steel, could be a guide to drill the holes in the aluminum extrusion especially when the extrusion was 'field cut to length' and the holes were removed with the scrap piece.

Figure 32:
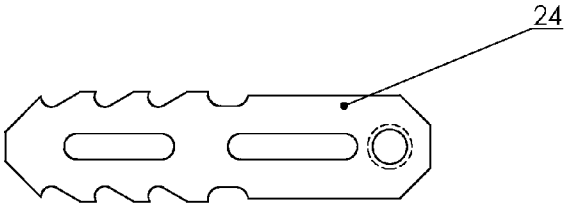
FIG. 32 illustrates a top view of the alignment plate 24, in accordance with an exemplary embodiment of the present invention.
Figure 33:
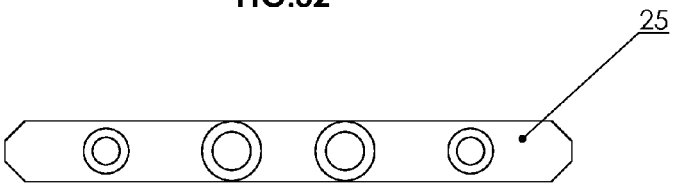
FIG. 33 illustrates a top view of the alignment plate 25, in accordance with an exemplary embodiment of the present invention.
Figure 34:
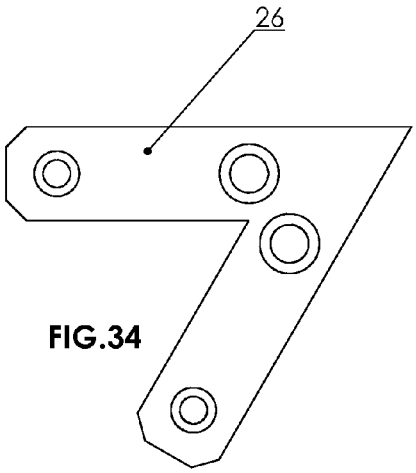
FIG. 34 illustrates a top view of an acute corner cleat 26, in accordance with an exemplary embodiment of the present invention.
Figure 35:
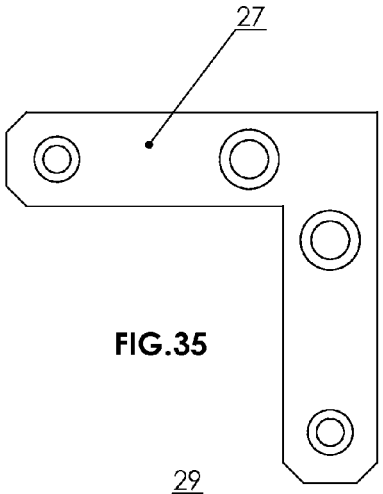
FIG. 35 illustrates a top view a normal corner cleat 27, in accordance with an exemplary embodiment of the present invention.
Figure 36:
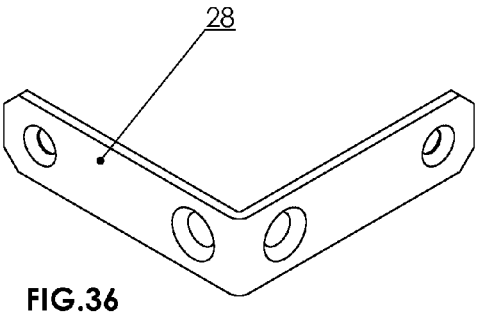
FIG. 36 illustrates a perspective view of a bent corner cleat 28, in accordance with an exemplary embodiment of the present invention.
Figure 37:
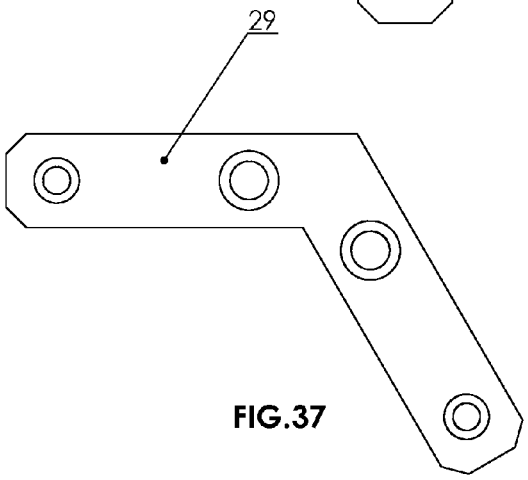
FIG. 37 illustrates a top view an obtuse corner cleat 29, in accordance with an exemplary embodiment of the present invention.
Figure 39:
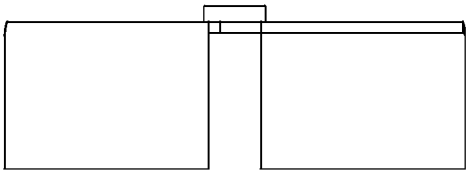
FIG. 39 illustrates a side view of a rotatable bracket 60, in accordance with an exemplary embodiment of the present invention.
Figure 38:
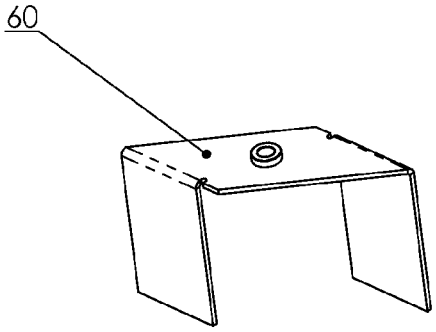
FIG. 38 illustrates a perspective view of a rotatable bracket 60, in accordance with an exemplary embodiment of the present invention.
Figure 40:
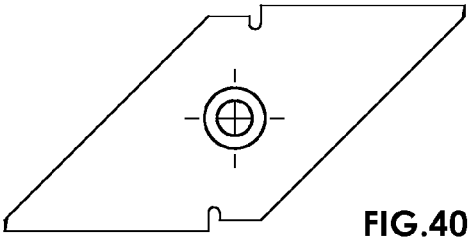
FIG. 40 illustrates a top view of a rotatable bracket 60, in accordance with an exemplary embodiment of the present invention.
Figure 41:
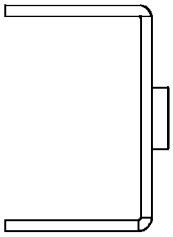
FIG. 41 illustrates a front view of a rotatable bracket 60, in accordance with an exemplary embodiment of the present invention.

A particular plate for linear alignment is depicted in FIG. 32, namely an aligner plate 24 with a jagged area on its first half and smooth zone on the second half with two slots and a tapped hole. This aligner plate 24 could be inserted into the 'T-slots' of any extrusion 10, 11 or 12 or in a separate H.V.W.C.2 T-slots of component 20 or 21.

The ribs 107, 117, 127 or 137 are intended to increase the heat transfer surface on the opposite side of surface 103, where the light engine is installed, and could be considered as heat sink fins.

Figure 19:
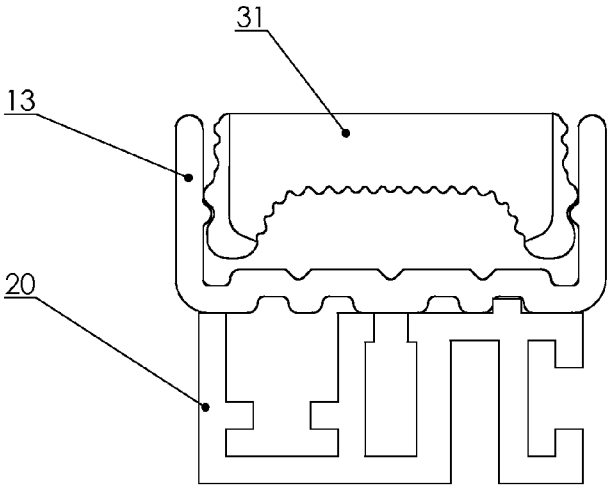
FIG. 19 illustrates a side view of a 'trim less' light engine housing, component 13, incorporating the co-extruded lens, component 31, and assembled on top of high voltage wire way chase, component 20, in accordance with an exemplary embodiment of the present invention.
Figure 20:
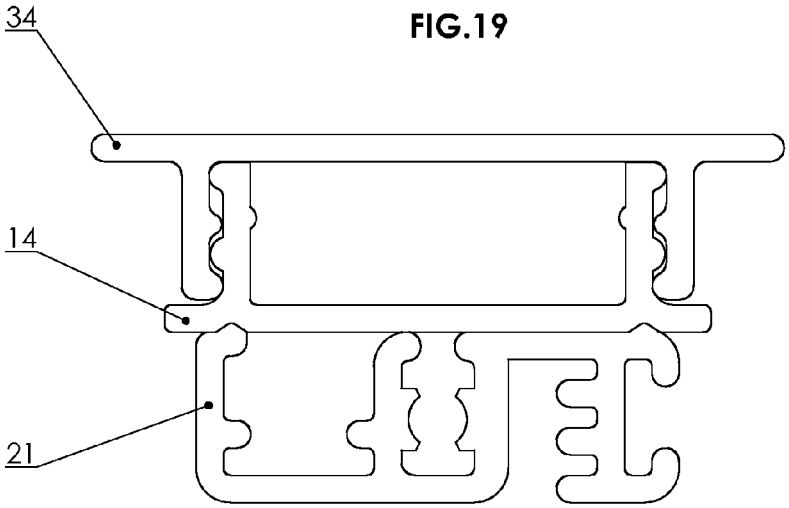
FIG. 20 illustrates a side view of another light engine housing, component 14, incorporating the extruded lens, component 34, and assembled on top of high voltage wire way chase, component 21, in accordance with an exemplary embodiment of the present invention.
Figure 21:
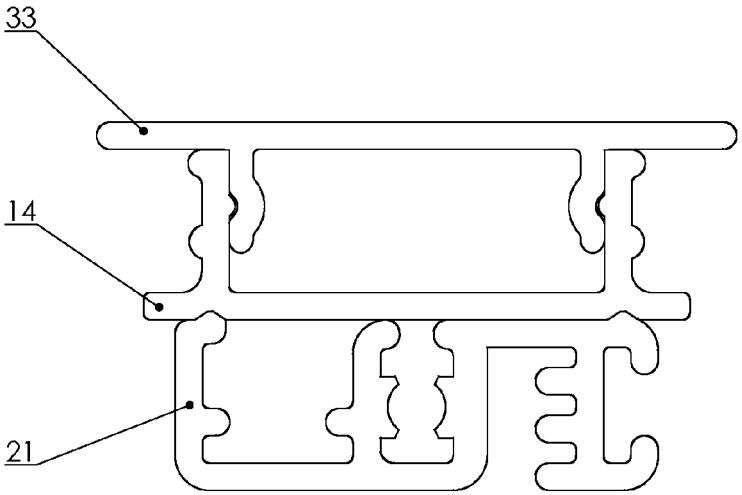
FIG. 21 illustrates a side view of another light engine housing, component 14, incorporating the extruded lens, component 33, and assembled on top of high voltage wire way chase, component 21, in accordance with an exemplary embodiment of the present invention.
Figure 42:
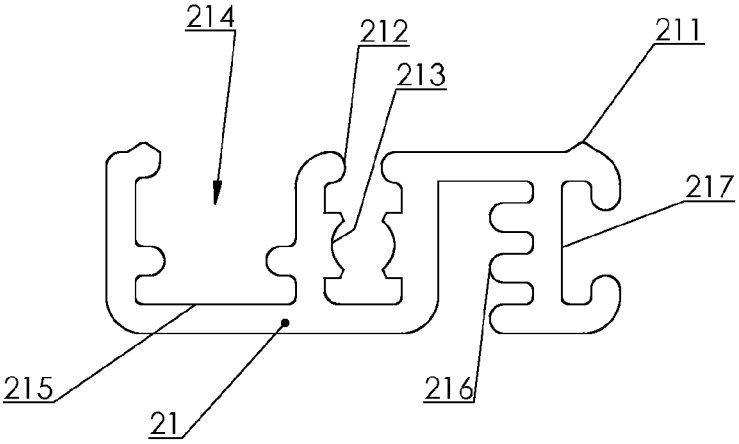
FIG. 42 illustrates a side view of a high voltage wire way chase, component 21, in accordance with an exemplary embodiment of the present invention.
Figure 43:
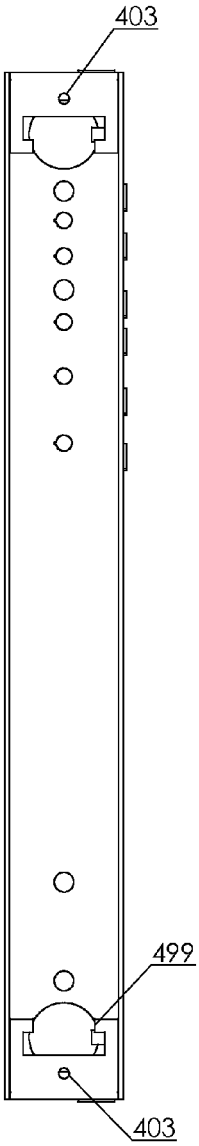
FIG. 43 illustrates a front view of component 40, named 'L.E.D. driver enclosure', in accordance with an exemplary embodiment of the present invention.
Figure 44:
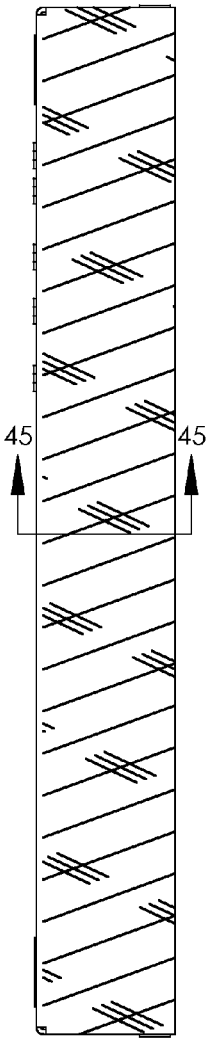
FIG. 44 illustrates a side view of component 40, named 'L.E.D. driver enclosure', in accordance with an exemplary embodiment of the present invention.

Another component of some lighting fixtures, especially those configurations with 'trim less' option, is the high voltage wire way chase, item 21 as illustrated in FIG. 42. This component could be made out of extruded aluminum. Feature 211 is intended to ensure the alignment of component 21 to component 14 as depicted in FIG. 20 and FIG. 21 or by matching feature 146 depicted in FIG. 31. The other grooves 106, 116, 126, 136 of FIG. 27 thru 30 are intended for the same purpose. Back to FIG. 42, the groove 212 is intended as a screw chase for the self-tapping screws driven from the light engine extrusions 10, 11, 12, 13 or 14. Feature 213 is intended as longitudinal screw chase for self-tapping screws driven from the ends as those intended to hold the end caps. The volume of feature 214 is the space where the high voltage wire 48 will be located, as seen in FIG. 13. Feature 215 is a T-slot feature intended for alignment plates or corner cleats. Screw chase 216 is created to allow installation of grounding screws on each segment that are required to ensure bonding of the wire way chase. T-slot 217 is intended for alignment plates or corner cleats in a plane perpendicular to 215. Another variation of component 21 is component 20, as depicted in FIG. 19 or FIG. 12.

Figure 15:
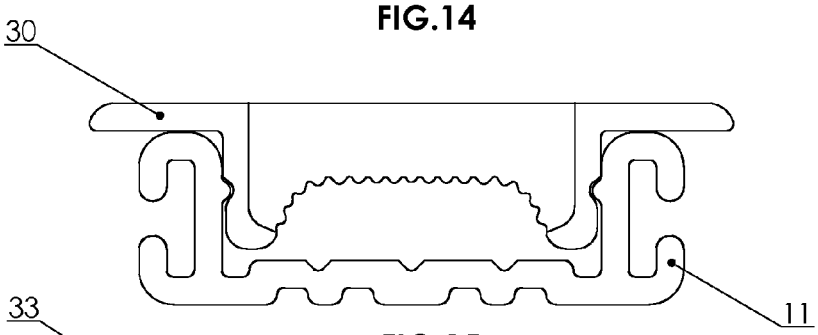
FIG. 15 illustrates a side view of other light engine housing, component 11, assembled with the co-extruded lens, component 30, in accordance with an exemplary embodiment of the present invention.
Figure 50:
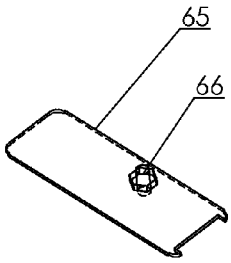
FIG. 50 illustrates an isometric view of component 65, named 'access door', in accordance with an exemplary embodiment of the present invention.
Figure 51:
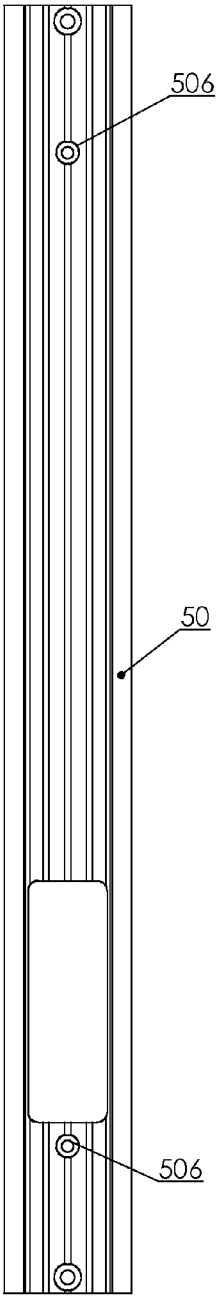
FIG. 51 illustrates a top view of component 50, named 'another power input segment housing for light engine', in accordance with an exemplary embodiment of the present invention, or "channel segment", in accordance with another embodiment of the present invention.
Figure 49:
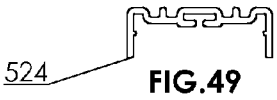
FIG. 49 illustrates a side view of component 52, named 'power input segment housing for light engine', in accordance with an exemplary embodiment of the present invention, or "channel segment", in accordance with other exemplary embodiment of the present invention.
Figure 52:
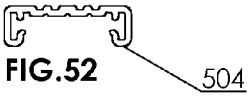
FIG. 52 illustrates a side view of component 50, named 'another power input segment housing for light engine', in accordance with an exemplary embodiment of the present invention, or "channel segment", in accordance with another embodiment of the present invention.

Another component of the lighting fixtures, exemplified in FIG. 50 and FIG. 15, is the access cover 65, preferrably made of sheet metal (aluminum or steel) but could also be an extruded aluminum component with secondary operations. Grounding screw 66 needs to be factory installed. This could be pre-installed with grounding wire, eyelet, nut and star washer (not shown).

Figure 22:
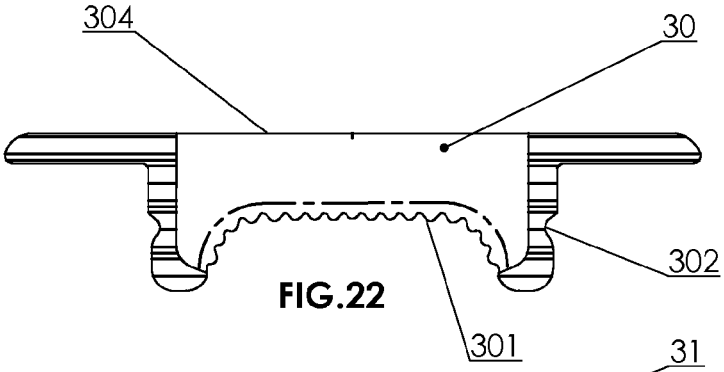
FIG. 22 illustrates a side view of optical element 30, in accordance with an exemplary embodiment of the present invention.
Figure 24:
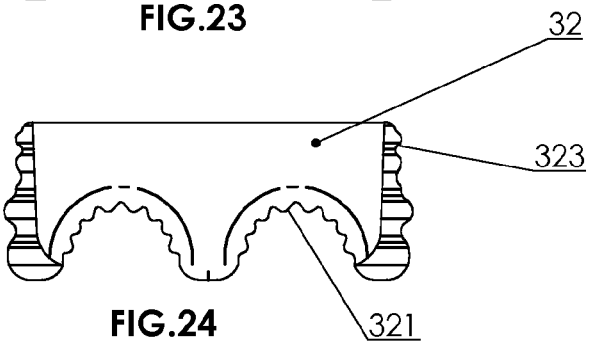
FIG. 24 illustrates a side view of another optical element 32, in accordance with an exemplary embodiment of the present invention.
Figure 25:
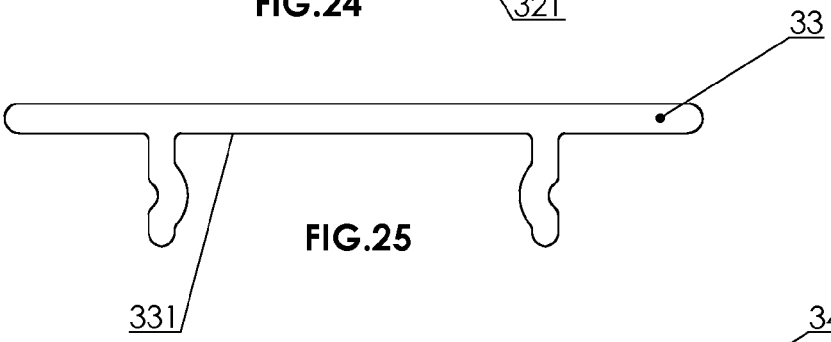
FIG. 25 illustrates a side view of another optical element 33, in accordance with an exemplary embodiment of the present invention.
Figure 26:
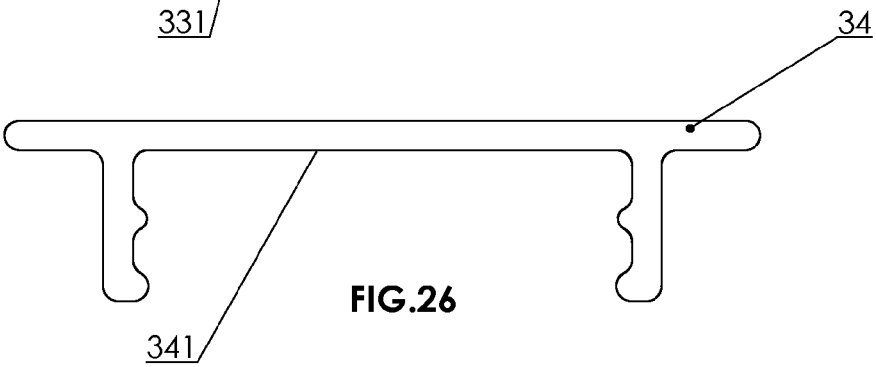
FIG. 26 illustrates a side view of another optical element 34, in accordance with an exemplary embodiment of the present invention.

FIG. 22 illustrates component 30, the lens or the light diffusing/converting optical element. The feature 301 is the base of the optical element placed near the light source. This surface could have different shapes as exemplified by profile 321 of FIG. 24 or profile 331 of FIG. 25 or profile 341 of FIG. 26. The feature 302, representing one or more indents on the side of the lens, is intended to retain the lens to the housing but in the same time allow easy snap in of the lens to the housing. The feature 313 or 323 is the surface that would create a sufficient gap between the lens and housing as to allow a thin object to be inserted between the lens and housing for the purpose of lens removal. The surface 304 is the light output surface of the optical element. The material for these lens could be acrylic, polycarbonate, remote phosphor or other optical materials used in the lighting industry or a combination of these materials mixed or co-extruded in a single piece.

The light source 70 is primarily comprised of L.E.D. The technology could be blue, static white, tunable white, RGB L.E.D. chips. The circuit could be soft strips, FR boards, OL.E.D.s or any other electroluminescent diode that is capable of generating radiation in response to an electrical signal.

Figures 3, 4, 5:
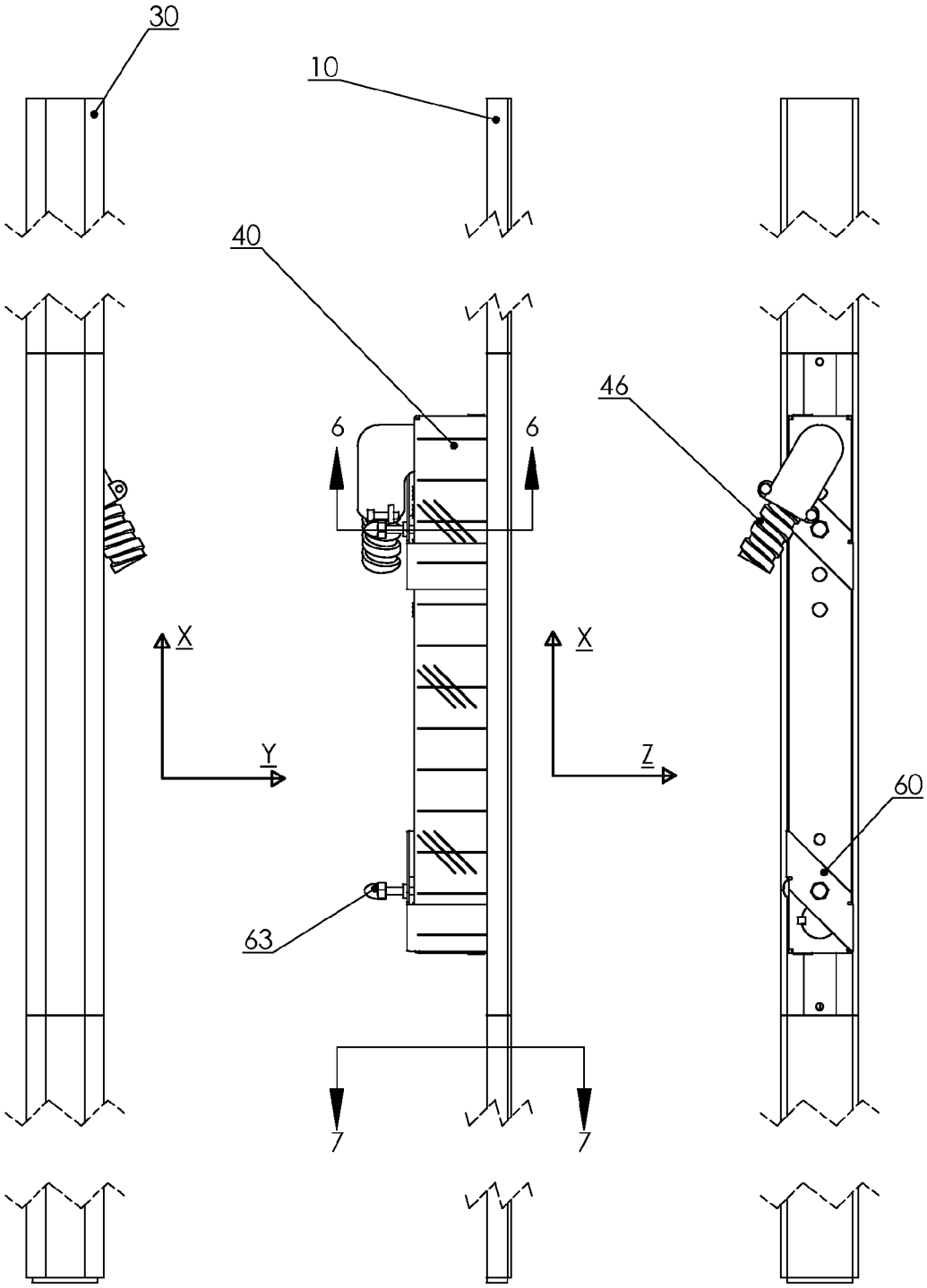
FIG. 3 illustrates a front view of a line segment of the concatenated run of linear fixtures, in accordance with an exemplary embodiment of the present invention.
FIG. 4 illustrates a top view of a line segment of the concatenated run of linear fixtures, in accordance with an exemplary embodiment of the present invention.
FIG. 5 illustrates a back view of a line segment of the concatenated run of linear fixtures, in accordance with an exemplary embodiment of the present invention.
Figure 6:
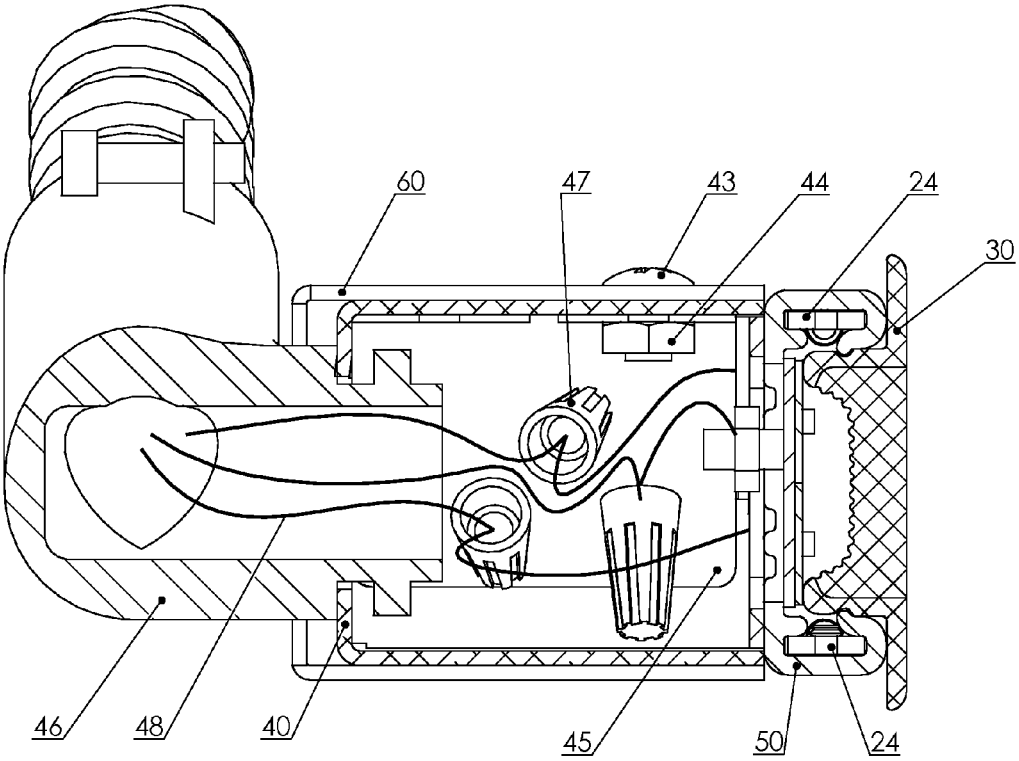
FIG. 6 illustrates section view of a line segment of the concatenated run of linear fixtures taken along section line 6-6 as labeled in FIG. 4, in accordance with an exemplary embodiment of the present invention.
Figure 46:
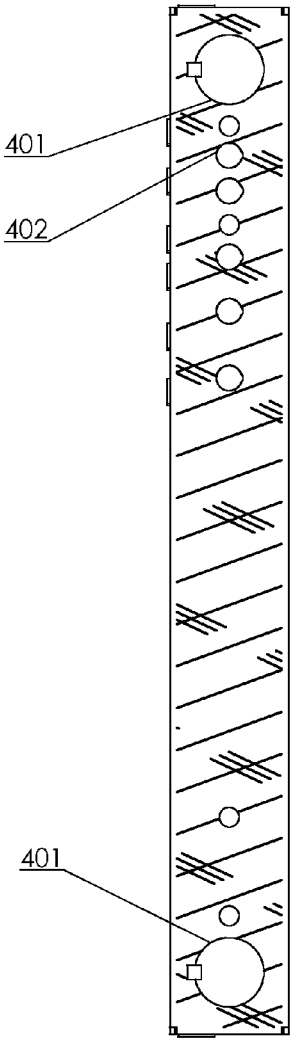
FIG. 46 illustrates a back view of component 40, named 'L.E.D. driver enclosure', in accordance with an exemplary embodiment of the present invention.

FIGS. 43, 44, 45, 46 and 47 illustrates different view angles of an L.E.D. driver enclosure (D.E.2) component 40. In FIG. 46, the feature 401 is a knockout intended to be removed if a strain relief device, like an elbow fitting 46 depicted in FIG. 5 or FIG. 6, would need to be installed to the D.E.2 to provide power or data wires inside the enclosure.

The wiring of the L.E.D. driver enclosure (D.E.2) could be done thru any opening on the back of the enclosure ('knock out' holes, access hole and cover plate, etc.) There could be one, two or more K.O. that could receive one, two or more elbow connectors, first being to feed the power wires, a second one to feed the control wires (for example the 0-10V wires). The K.O. could be removed by pushing against the round cap from inside with a screw driver. The D.E.2 could be made of aluminum sheet metal or steel. The elbow could be an off the shelf item usually made of metals (zinc, steel)

Figure 45:
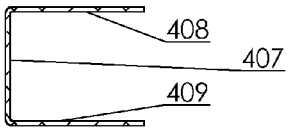
FIG. 45 illustrates a section view of component 40, taken along section line 45-45 as labeled in FIG. 44, in accordance with an exemplary embodiment of the present invention.
Figure 47:
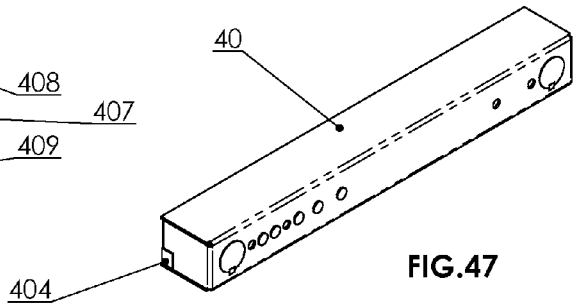
FIG. 47 illustrates an isometric view of component 40 named 'L.E.D. driver enclosure', in accordance with an exemplary embodiment of the present invention.
Figure 48:
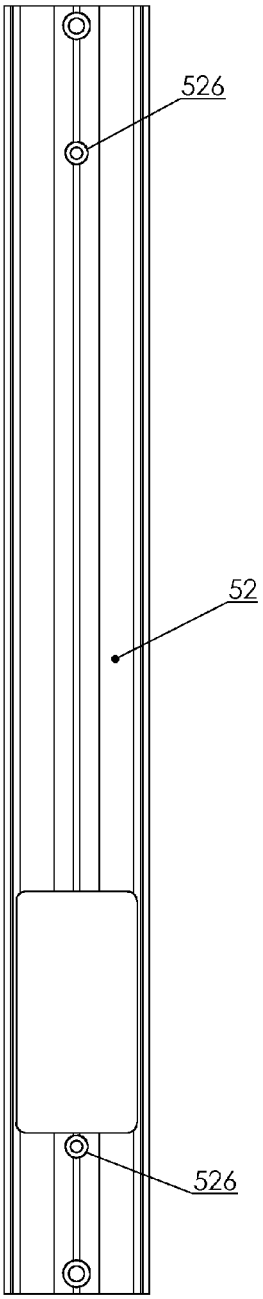
FIG. 48 illustrates a top view of component 52, named 'power input segment housing for light engine', in accordance with an exemplary embodiment of the present invention, or "channel segment", in accordance with other exemplary embodiment of the present invention.

Continuing description of features at FIG.46, the feature 402 represents an array of half-shear or smaller K.O. features intended for easy removal when a screw 43 and nut 44 (FIG. 6) needs to be installed either to mount the L.E.D. driver 45 directly or thru an intermediate bracket to the D.E.2 labeled 40. The hole 403 (FIG. 43) is intended to receive a self-tapping screw 57 as depicted in FIG. 62. The screw 57 is mounting the housing 50 to D.E.2 component 40 and ensures bonding of those two components. The surface 407 is the back surface of D.E.2 component 40 that could serve as the mounting surface to L.E.D. driver or mounting brackets. Alternatively, 408 or 409 surfaces could be used to support the footprint of the driver or mounting brackets. The tabs 499 are stop features that could be formed from the same piece of driver enclosure D.E.2 or could be made out of separate pieces, intended to support the access doors while they are shut and to prevent them from swinging inside the electrical enclosure, as depicted in FIG. 63-A;

On the back side of the driver enclosure we can see a set of small mounting K.O. arranged in any appropriate pattern to match the footprint of a series of L.E.D. drivers intended to be installed for every fixture configuration or by using intermediate mounting bracketing. The mounting of the driver depicted in the exemplary embodiment is not intended to restrict the other options that are not shown here as this driver could be installed on the other adjacent surfaces 408 or 409 of the driver enclosure D.E.2, as seen in FIG. 45. The K.O. 404 depicted in FIG. 47 is to be removed when there is a need to use wire way chase H.V.W.C.2.

FIG. 60, FIG. 61, FIG. 62, FIG. 63 and FIG. 63-A are illustrating D.E.2 component 40 when the access door 65 is open for splice inspection. Soft strips connectors 71 and low voltage wires 49 are depicted in FIG. 62. The enclosure 40 is considered as being "recessed" and, together with the elbow connector 46, intended to fit within the "depth" limitation of that space, labeled "D1", as depicted in FIG. 61 and FIG. 62. In general, an enclosure is considered "sufficiently recessed" if its depth, measured from its mounting surface, is less than "D1" and its protrusions are equal or less than the thickness of the planar surface "D" plus the thickness of the plaster, if any. The plaster thickness is usually between 1 mm to 6 mm. In one exemplary embodiment of this invention, the dimension "D" could take values ranging between ¼ inch to 2 inches. In general, the materials that are used to manufacture the electrical enclosures and the wire way chase integral to a channel, are: metals (carbon steel, stainless steel, aluminum, etc.), thermoset polyesters (i.e. fiberglass), thermoplastic (i.e. polycarbonate, ABS, etc.), polyesters, fire retardant plastics, etc. The "depth" of the driver enclosure is limited by the size of the structural elements. In an exemplary embodiment of this invention, an enclosure, mounted on a 2"×4" (2 inches by 4 inches) structural member, is considered "sufficiently recessed", if its depth, measured from its mounting surface, is less than 4 inches and its protrusions are less than the thickness of the planar surface into which it is installed.

Figure 23:
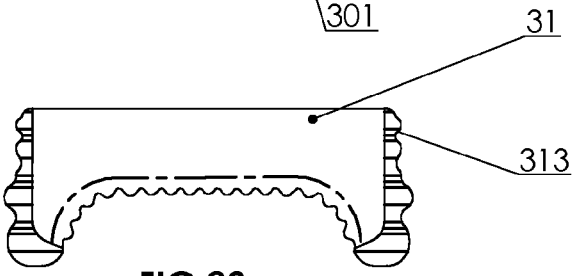
FIG. 23 illustrates a side view of another optical element 31, in accordance with an exemplary embodiment of the present invention.

The Power input segment/housing light engine 50 as illustrated in FIG. 48 thru 52 could be made out of channel housing. Alternatively, in another embodiment, the term "channel segment" is used in reference to component 50, within the scope of the invention, but not limited to that particular embodiment. The channel segment and the channel housing materials could be metals (carbon steel, stainless steel, aluminum, etc.), thermoset polyesters (i.e. fiberglass), thermoplastic (i.e. polycarbonate, ABS, etc.), polyesters, fire retardant plastics, etc. This segment is intended to match the profile of the extruded light engine housing 10 and ensure row continuity along the lens lines. Also, it is needs to allow inspector access to the wire splice compartment. Also, it needs to support the light sources. As illustrated in FIG. 23, the edges 504 and 524 are highly visible and are supposed to match 101 and 121 edges of the component 10 as presented in FIG. 27 and FIG. 29. The holes 506 or 526 illustrates a countersink hole that is intended to receive a self-tapping screw 57, on each side of the housing 50 as depicted in FIG. 62. The component 65, FIG. 50, is an access door that could be manufactured from metal material. As depicted by FIG. 62 and by FIG. 63-A, while the soft strips 70 are installed on the door 65, the door could be opened without removing the strips because the soft strips are flexible light engines.

Figure 53:
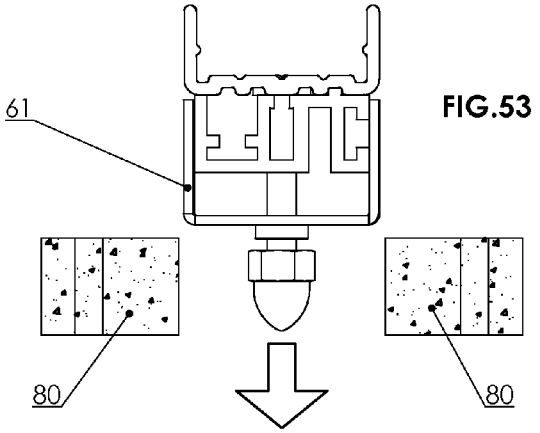
FIG. 53 illustrates a side view of a 'trim less' light engine housing coupled with high voltage wire way chase and rotatable bracket depicted before it is about to be inserted in a gap of a planar surface 80, in accordance with an exemplary embodiment of the present invention.
Figure 56:
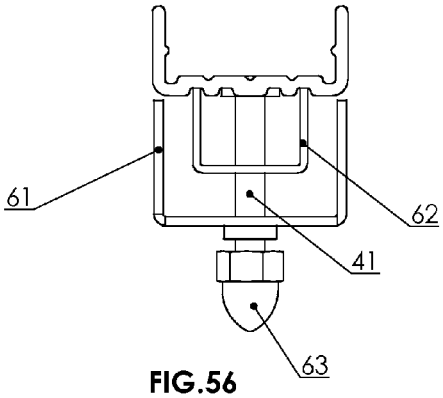
FIG. 56 illustrates a side view of a 'trim less' light engine housing without high voltage wire way chase but with a bracket stop 62 to stop rotation of rotatable bracket, depicted before it is about to be inserted in a gap of a planar surface 80, in accordance with an exemplary embodiment of the present invention.
Figure 54:
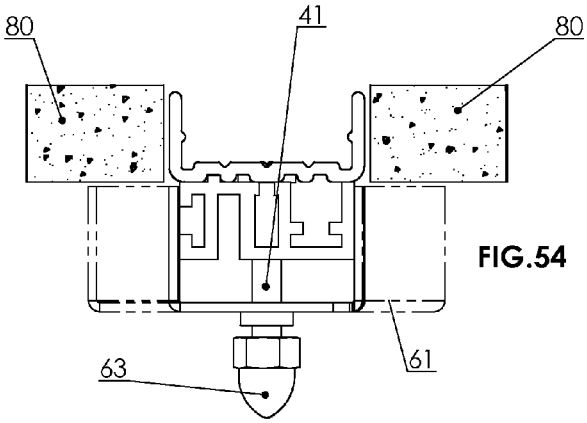
FIG. 54 illustrates a side view of a 'trim less' light engine housing coupled with high voltage wire way chase and rotatable bracket depicted after it was inserted in a gap of a planar surface 80, in accordance with an exemplary embodiment of the present invention.
Figure 57:
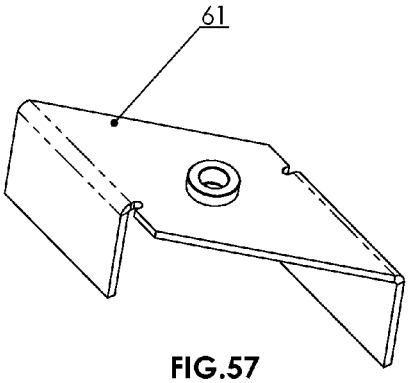
FIG. 57 illustrates a perspective view of a rotatable bracket 61, in accordance with an exemplary embodiment of the present invention.
Figure 55:
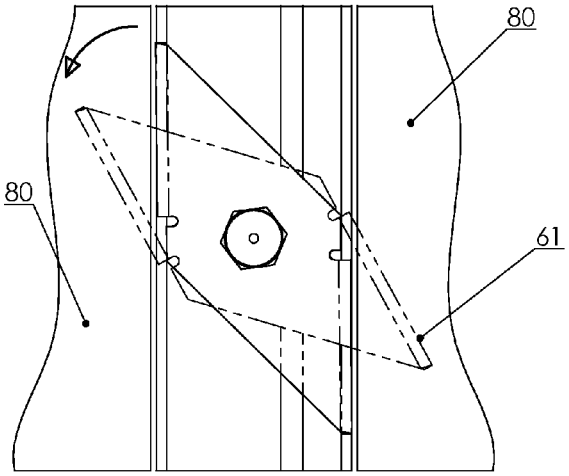
FIG. 55 illustrates a top view of a 'trim less' light engine housing coupled with high voltage wire way chase and rotatable bracket depicted after it was inserted in a gap of a planar surface 80, in accordance with an exemplary embodiment of the present invention.
Figure 58:
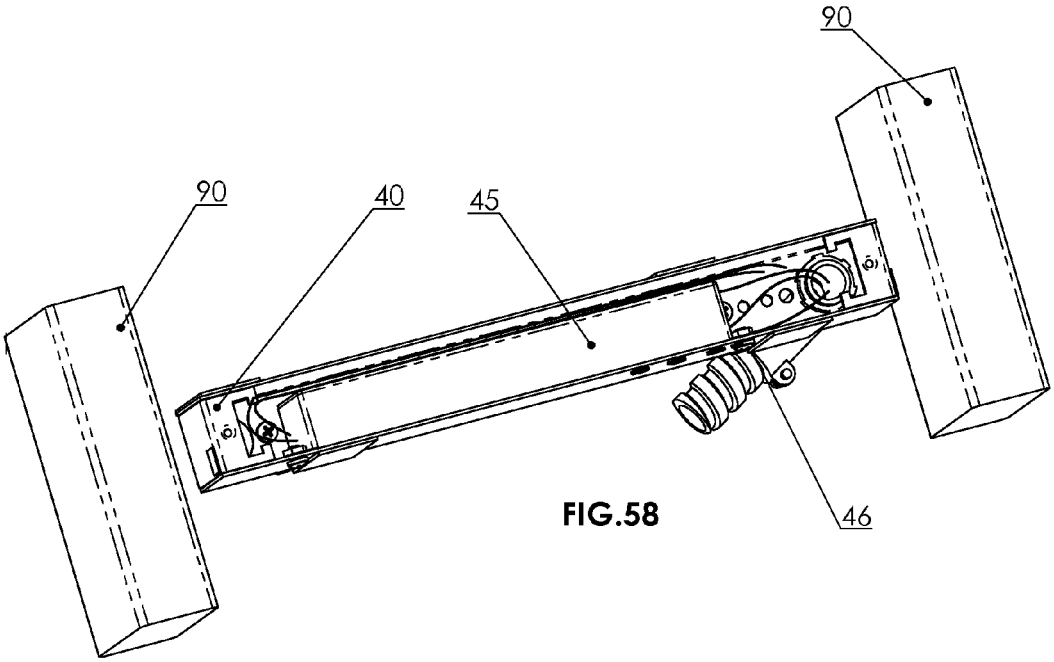
FIG. 58 illustrates an isometric view, frontal perspective, of the internal components of an L.E.D. driver enclosure about to be installed to the frame structure.
Figure 59:
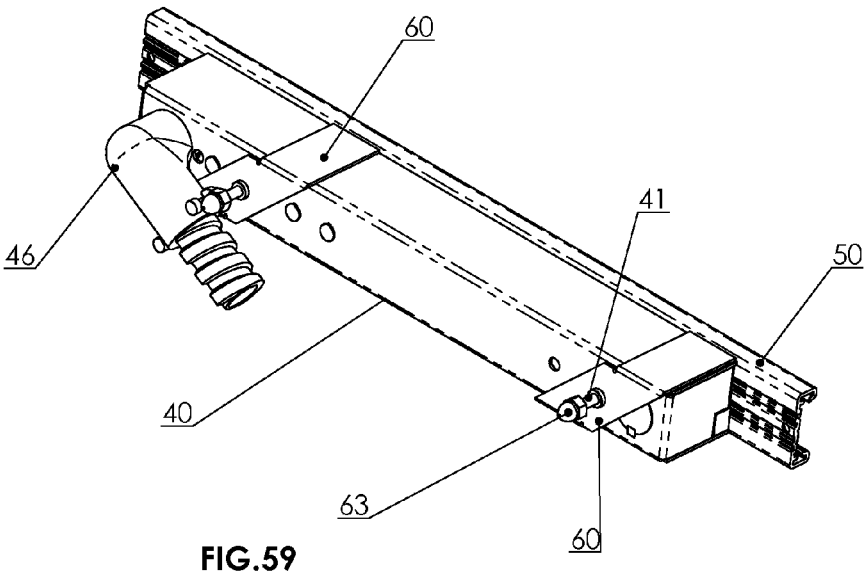
FIG. 59 illustrates an isometric view, rear perspective, of the external components attached to the back of an L.E.D. driver enclosure.

As illustrated by FIG. 53 thru FIG. 55, the installation of the light engines to the planar surface could be done by using a rotatable bracket 61. The bracket would be positioned initially as to allow the kit to be inserted thru the gap in the planar surface 80, as illustrated in FIG. 53. Once the light engines are sitting on the structural member, the bracket could be rotated by turning the actuator screw 41. To avoid turning the screw in the wrong direction, a locking nut 63 is mounted to each actuator screw. This locking nut is preventing the loss of the rotatable brackets 60 or 61 inside of a wall, for example. The component 20 or 21 could be used to stop rotation of the bracket 61, once the kit was inserted, or a bracket stop 62 could be an alternative solution. Similarly, the installation of the D.E.2 compartment could be done by using a rotatable bracket 60 (FIG. 59).

The envelope of the fixture components installed on the framework that is supporting the architectural surface is defined as having the thickness of the respective surface, labeled 'D' as illustrated by FIG. 11. A section view thru the driver compartment of the lighting system is presented in FIG. 6. Most of the components description could be found in previous paragraphs except the wire nuts 47 that are used in the industry to make quick connections between solid copper wires 48.

Figure 16:
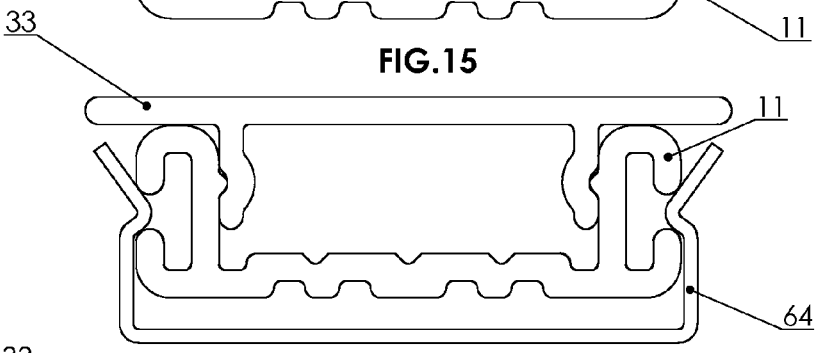
FIG. 16 illustrates a side view of light engine housing, component 11, assembled with the extruded lens, component 33, in a surface mount configuration, in accordance with an exemplary embodiment of the present invention.
Figure 17:
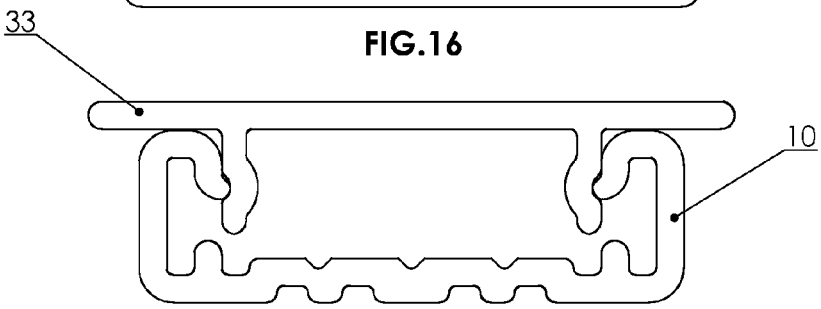
FIG. 17 illustrates a side view of other light engine housing, component 10, assembled with extruded lens, component 33, in accordance with an exemplary embodiment of the present invention.
Figure 18:
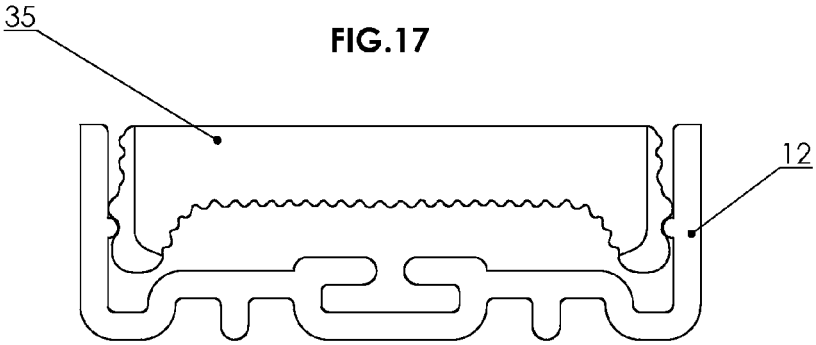
FIG. 18 illustrates a side view of other light engine housing, component 12, assembled with the co-extruded lens, component 35, in accordance with an exemplary embodiment of the present invention.

The linear fixtures could be installed as semi-recessed configuration, where only the D.E.2 is recessed while the light engine housings are above the planar surface. Other configuration could be when the light engine housings are surface mounted (for example, using a clip 64 as seen in FIG. 16).

In summary, these are the functions of the main components, or their features, as described previously:

Electrical enclosure 40 a) contains the L.E.D. driver and driver mounting means (brackets, screw, etc.);

b) contains "knockouts" to be removed as needed, to install elbow connector(s);

Channel/light engine housing 10 a) prevent dirt particles to reach the reflective surface, the optical surface or the L.E.D. chips;

b) retain the light diffusing or light converting optical element;

c) support the L.E.D. light source and transfer the heat out of the light engine;

wire way chase 20 is intended to:

a) protect the high voltage wire according to the safety standards;

channel segment or power input segment/housing-light engine 50 a) have an opening for the access doors;

b) have mounting holes to attach the electrical enclosure;

c) prevent dirt particles to reach the reflective surface, the optical surface or the L.E.D. chips;

light diffusing or light converting optical element 30 a) convert blue light to white light;

b) spread the incident light rays coming from L.E.D. point source to a surface illumination;

In other exemplary embodiment, we define a method of mounting at least one linear lighting fixture on the structural members supporting at least one planar surface, comprising:

a) forming a gap in at least one planar surface and a cut-out in at least one structural member;

b) installing at least one electrical enclosure bearing an electrical device attached to a power source, disposed between said structural members, along said gap;

c) mounting at least one way chase in the cut-out of at least one structural member;

d) mounting at least one channel on said structural members, in the said gap, recessed within said planar surfaces;

e) installing a light source into said channel;

f) connecting said light source to the electrical device; and g) coupling at least one removable cover to said channel.

In other exemplary embodiment, we define another method of mounting at least one linear lighting fixture on the structural members supporting at least one planar surface, comprising:

a) forming a gap in at least one planar surface;

b) installing at least one electrical enclosure bearing an electrical device attached to a power source, disposed between said structural members, along said gap;

c) mounting at least one channel on said structural members, in the said gap, recessed within said planar surfaces;

d) installing a light source into said channel;

e) connecting said light source to the electrical device; and f) coupling at least one removable cover to said channel.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A linear lighting fixture, comprising:

a channel segment, mounted on at least two structural members that are supporting a planar surface;

an enclosure, disposed between said structural members, adjoined to said channel segment wherein said enclosure is sufficiently recessed behind its mounting surface and containing an electrical device used as a power source and control;

a channel housing, abutted to and aligned with said channel segment and mounted on at least one structural member;

a wire way chase, mounted recessed in a cut-out performed in said structural member, disposed between said channel and said structural member;

a light source, containing electroluminescent diodes, mounted in said channel, and connected to said electrical device; and, a removable cover, mounted on said channel;

wherein said channel segment, bearing an opening to access said adjoining enclosure, would allow access, for maintenance, to said power source, after said fixture installation.

2. The lighting fixture of claim 1, wherein said channel is sufficiently recessed behind said planar surface.

3. The lighting fixture of claim 1, wherein said removable cover is purposed for diffusion of light or alteration of light wavelength.

4. The lighting fixture of claim 1, wherein said cover is purposed to be removed for the maintenance of said light source.

5. The lighting fixtures of claim 1, wherein said channel segment, could be removed and re-installed, without damaging the surrounding finished surfaces, for maintenance or replacement of said electrical device.

6. The lighting fixture of claim 1, wherein said electrical enclosure would have at least one access door, on the channel side, for wire splice inspection and to conceal the additional L.E.D. tape inside the electrical enclosure.

7. The lighting fixture of claim 1, wherein said opening to access said adjoining enclosure comprise a hinged joint for opening an access door, or a sliding plate, enabling easy access to adjoining enclosure.

8. The electrical enclosure of claim 6, wherein at least one access door could be opened while the L.E.D. light source is attached to it.

9. The lighting fixtures of claim 1, that is to be joined with other fixture, by at least one alignment plate.

10. The particular alignment plate of claim 9, that could have a jagged area on its first half, and a smooth zone on the second half, with one slot along each zone and a tapped hole on the smooth zone where the above plate could be press fit in an extrusion channel and travel up to a stop surface created by a second plate temporarily inserted in the slot of the smooth zone of the first alignment plate.

11. The electrical enclosure of claim 6, where at least one tab (499) is formed from the body of said enclosure or at least a stop is attached to the body of the enclosure and is intended to support the access doors while they are shut and to stop them from swinging inside the electrical enclosure.

12. The lighting fixture of claim 1, wherein said channel contains a heat-conducting material.

13. A method of mounting at least one linear lighting fixture on the structural members supporting at least one planar surface, comprising:

a) forming a gap in at least one planar surface and a cut-out in at least one structural member;

b) installing at least one electrical enclosure bearing an electrical device attached to a power source, disposed between said structural members, along said gap;

c) mounting at least one wire way chase in the cut-out of at least one structural member;

d) mounting at least one channel on said structural members, in the said gap, recessed within said planar surfaces;

e) installing a light source into said channel;

f) connecting said light source to the electrical device; and g) coupling at least one removable cover to said channel.

14. The lighting fixture arrangement of claim 13, comprising multiple lighting fixtures connected end to end, as a continuous run, and positioned to follow the direction of adjacent planar surfaces in three dimensional spaces while maintaining the structural integrity of the supporting framework and in compliance with the majority of building code specifications.

15. A linear lighting fixture, comprising:

a channel segment, mounted on at least two structural members that are supporting a planar surface;

an enclosure, disposed between said structural members, adjoined to said channel segment wherein said enclosure is sufficiently recessed behind its mounting surface and containing an electrical device used as a power source and control;

a channel housing, abutted to and aligned with said channel segment and mounted on at least one structural member;

a light source, containing electroluminescent diodes, mounted in said channel, and connected to said electrical device; and, a removable cover, mounted on said channel;

wherein said channel segment, bearing an opening to access said adjoining enclosure, would allow access, for maintenance, to said power source, after said fixture installation.

16. The lighting fixture of claim 15, wherein said removable cover is purposed for diffusion of light or alteration of light wavelength.

17. The lighting fixtures of claim 15, wherein said channel segment, could be removed and re-installed, without damaging the surrounding finished surfaces, for maintenance or replacement of said electrical device.

18. The lighting fixture of claim 15, wherein said electrical enclosure would have at least one access door, on the channel side, for wire splice inspection and to conceal the additional L.E.D. tape inside the electrical enclosure.

19. The electrical enclosure of claim 15, wherein at least one access door could be opened while the L.E.D. light source is attached to it.

20. The lighting fixture of claim 15, wherein said opening to access said adjoining enclosure comprise a hinged joint for opening an access door, or a sliding plate, enabling easy access to adjoining enclosure.

* * * * *